US006398563B1

(12) United States Patent
Kanagawa et al.

(10) Patent No.: US 6,398,563 B1
(45) **Date of Patent: *Jun. 4, 2002**

(54) SHIELD CONNECTOR

(75) Inventors: Syuuichi Kanagawa; Ichiaki Sano; Takao Nozaki, all of Nagoya; Kiyofumi Ichida, Yokkaichi, all of (JP)

(73) Assignees: Autonetworks Technologies, Ltd., Nagoya; Sumitomo Wiring Systems, Ltd., Mie; Sumitomo Electric Industries, Ltd., Osaka, both of (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/686,905

(22) Filed: Oct. 12, 2000

(30) Foreign Application Priority Data

Feb. 24, 2000 (JP) ..... 2000-046947
Feb. 25, 2000 (JP) ..... 2000-049795

(51) Int. Cl.[7] ..... H01R 13/648

(52) U.S. Cl. ..... 439/98; 439/610; 439/587

(58) Field of Search ..... 439/98, 99, 518, 439/587, 604, 610; 174/178, 35 R; 114/36

(56) References Cited

U.S. PATENT DOCUMENTS 6,053,749 A 4/2000 Masuda et al.
6,107,572 A * 8/2000 Miyazki ..... 174/75 C
6,246,002 B1 * 6/2001 Rumsey ..... 174/84 R
6,261,108 B1 * 7/2001 Kanagawa et al. ..... 439/98

FOREIGN PATENT DOCUMENTS

EP 0 818 854 A1 1/1998
FR 2 601 196 A1 1/1898
FR 2 768 563 A1 3/1999
GB 1 276 307 A 6/1972

* cited by examiner

*Primary Examiner*—Tho D. Ta
*Assistant Examiner*—James R. Harvey
(74) *Attorney, Agent, or Firm*—Oliff & Berridge, PLC

(57) ABSTRACT

A shield connector is arranged such that a flange 22 fixed to a mating shielding wall W is made electrically conductive, and a shielding layer 13 of a shielding wire 10 is conductingly connected to an electrically conductive sleeve 26 which is formed integrally therewith. Consequently, the structure for allowing the shielding layer 13 and the mating shielding wall to conduct with each other can be simplified, and the number of parts can be reduced.

A flange 22 provided in a shield connector has electrical conductivity and is provided with a U-shaped slot portion 24 which is capable of accommodating a shielding wire 10 from a lateral direction. A shielding layer 13 of the shielding wire 10 is brought into close contact with the inner surface of this U-shaped slot portion 24 so as to set the shielding layer 13 and the flange 22 in a conductingly connected state, and this subassembly is inserted in a mold to form a housing 21. Thus, with the shield connector in accordance with the invention, since the flange 22 fixed to a mating shielding wall is made electrically conductive, and the shielding layer 13 is conductingly connected to this flange 22, the structure for allowing the shielding layer 13 and the mating shielding wall to conduct with each other can be simplified, and the number of parts can be reduced.

15 Claims, 19 Drawing Sheets

SHIELD CONNECTOR

BACKGROUND OF THE INVENTION

The present invention relates to a shield connector.

FIGS. 19 and 20 shows a shield connector disclosed in the Unexamined Japanese Patent Application Publication No. Hei 11-26093 as an example of a conventional shield connector. This shield connector is comprised of a rubber ring 2, a retaining ring 3, an electrically conductive sleeve 4, and a presser ring 35 which are provided in a tubular resin housing 1, and these members are fitted over a shielding wire 10 and are attached. In addition, a conductive contact piece 6 is disposed on an outer peripheral surface of a front end of the resin housing 1, and is conductingly connected to a shielding layer 13 of the shielding wire 10 through the electrically conductive sleeve 4. Then, if a flange 7 formed on the resin housing 1 in a jutting-out manner is pressed against an opening edge of an attaching hole formed in a shielding wall of an unillustrated electrical apparatus and is bolted, the conducting contact piece 6 is conductingly connected to an inner peripheral surface of the attaching hole, thereby allowing the shielding wall and the shielding layer to be conductingly connected to each other.

With the configuration of the conventional shield connector, there are as many as six basic component parts (parts designated by the aforementioned reference numerals), and if the other small parts are combined, the number of parts becomes very large, as shown in FIG. 20. For this reason, a large number of manufacturing steps are involved, so that there has been a problem in that the cost becomes high.

SUMMARY OF THE INVENTION

The present invention has been devised in view of the above-described circumstances, and its object is to provide a shield connector having a small number of parts.

<Invention According to Aspect 1>

The shield connector in accordance with the invention according to aspect 1 is a shield connector which covers a shielding layer exposed at a terminal portion of a shielding wire and is fixed to the shielding wire, and which is attached to a mating shielding wall to conductingly connect the sealing layer and the mating shielding wall, characterized by comprising: an electrically conductive flange having electrical conductivity and adapted to abut against the mating shielding wall; en electrically conductive tubular portion provided in a state of being electrically conducting with the electrically conductive flange and fitted to an inner side or an outer side of the exposed shielding layer so as to be conductingly connected to the shielding layer; and a housing fixed to the shielding wire to hold the electrically conductive flange.

In accordance with the invention, the flange which is fixed to the mating shielding wall is made electrically conductive, and the shielding layer is conductingly connected to this electrically conductive flange through the electrically conductive tubular portion, whereby the structure for allowing the shielding layer and the mating shielding wall to electrically conduct with each other can be simplified, and the number of parts can be reduced.

<Invention According to Aspect 2>

In accordance with the invention according to aspect 2, the shield connector according to aspect 1 further comprises an auxiliary sleeve fitted to the electrically conductive tubular portion with the shielding layer placed therebetween.

According to this arrangement, the shielding layer is clamped between the electrically conductive tubular portion and the auxiliary sleeve, thereby allowing the shielding layer to be conductingly connected to the electrically conductive tubular portion reliably.

<Invention According to Aspect 3>

In accordance with the invention according to aspect 3, the shield connector according to aspect 1 is characterized in that the electrically conductive tubular portion and the shielding layer are fused to each other, thereby allowing the shielding layer to be conductingly connected to the electrically conductive tubular portion reliably.

<Invention According to Aspect 4>

In accordance with the invention according to aspect 4, the shield connector according to any one of aspects 1 to 3 is characterized in that the housing is molded by charging a molten resin into a mold for resin molding in a state in which the shielding wire is placed inside the mold.

<Invention According to Aspect 5>

In accordance with the invention according to aspect 5, the shield connector according to aspect 4 is characterized in that a waterproofing tubular portion in which a synthetic resin softer than the housing is molded on an outer peripheral surface of the shielding wire prior to molding the housing is provided on an inner side of a rear end portion of the housing.

According to this arrangement, the waterproofing tubular portion which is softer than the housing is brought into close contact with the housing and the shielding wire, so that the rear end portion of the housing is provided with waterproof processing.

<Invention According to Aspect 6>

In accordance with the invention according to aspect 4 or 5, the shield connector according to aspect 4 or 5 is characterized in that a resin flowing-in hole for allowing a molten resin to pass therethrough is penetratingly formed in the electrically conductive flange.

According to this arrangement, if the molten resin is charged into the mold for resin molding in the state in which the shielding wire with the electrically conductive flange attached thereto is placed inside the mold, the molten resin passes through the resin flowing-in hole formed in the electrically conductive flange, thereby allowing the front side and the rear side of the housing with the electrically conductive flange placed therebetween to be molded at one time.

<Invention According to Aspect 7>

The shield connector in accordance with the invention according to aspect 7 is a shield connector which covers a shielding layer exposed at a terminal portion of a shielding wire and is fixed to the shielding wire, and which is attached to a mating shielding wall to conductingly connect the sealing layer and the mating shielding wall, characterized by comprising: an electrically conductive flange having electrical conductivity and adapted to abut against the mating shielding wall; a U-shaped slot portion formed in the electrically conductive flange and adapted to accommodate an exposed portion of the shielding layer of the shielding wire and to be conductingly connected to the shielding layer; and a housing molded by disposing the shielding wire together with the electrically conductive flange in a mold for resin molding and by charging a resin into the mold.

To attach the shield connector of aspect 7 to the shielding wire, the flange is pressed against the shielding wire from a lateral direction, and the shielding layer of the shielding wire is brought into close contact with the inner surface of the U-shaped slot portion formed in the flange, thereby conductingly connecting the shielding layer and the flange. Then, this subassembly is inserted in a mold to mold the housing. Here, in the invention, the flange which is fixed to the mating shielding wall is made electrically conductive, and the shielding layer is conductingly connected to this electrically conducting flange, so that the structure for allowing the shielding layer and the mating shielding wall to conduct with each other can be simplified, and the number of parts can be reduced. Moreover, since the electrically conductive flange is attached from the lateral direction of the shielding wire, the attaching operation is facilitated as compared with an arrangement in which the electrically conductive flange is attached along the axial direction of the shielding wire.

<Invention According to Aspect 8>

In accordance with the invention according to aspect 8, in the shield connector according to aspect 7, the inner sleeve is fitted on an inner side of the shielding layer, and the shielding layer is clamped by the inner sleeve and the inner surface of the U-shaped slot portion, thereby allowing the shielding layer to be conductingly connected to the electrically conductive flange reliably.

<Invention According to Aspect 9>

In accordance with the invention according to aspect 7, the shield connector according to aspect 7 is characterized by further comprising an auxiliary barrel extending along the shielding wire and having at one end thereof a crimping portion for the shielding layer and at another end thereof a U-shaped curved portion for being brought into close contact with an inner surface of the U-shaped slot portion.

In the arrangement according to aspect 9, the crimping portion provided at one end of the auxiliary barrel is crimped against the shielding layer of the shielding wire, and the U-shaped curved portion provided at the other end thereof is pressed into the U-shaped slot portion formed in the electrically conductive flange, thereby allowing the electrically conductive flange to be conductingly connected to the shielding layer reliably through the auxiliary barrel.

<Invention According to Aspect 10>

In accordance with the invention according to aspect 10, the shield connector according to aspect any one of aspects 7 to 9 is characterized in that a waterproof tubular portion in which a synthetic resin softer than the housing is molded on an outer peripheral surface of the shielding wire prior to molding the housing is provided on an inner side of a rear end portion of the housing.

In accordance with this arrangement, the waterproof tubular portion softer than the housing is brought into close contact with the housing and the shielding wire, so that the waterproof processing of the rear end portion of the housing is provided.

DETAILED DESCRIPTION OF THE PREFERRED EMBODIMENTS

<First Embodiment>

Referring next to FIGS. 1 to 5, a description will be given of a first embodiment of the invention.

Figure 1:
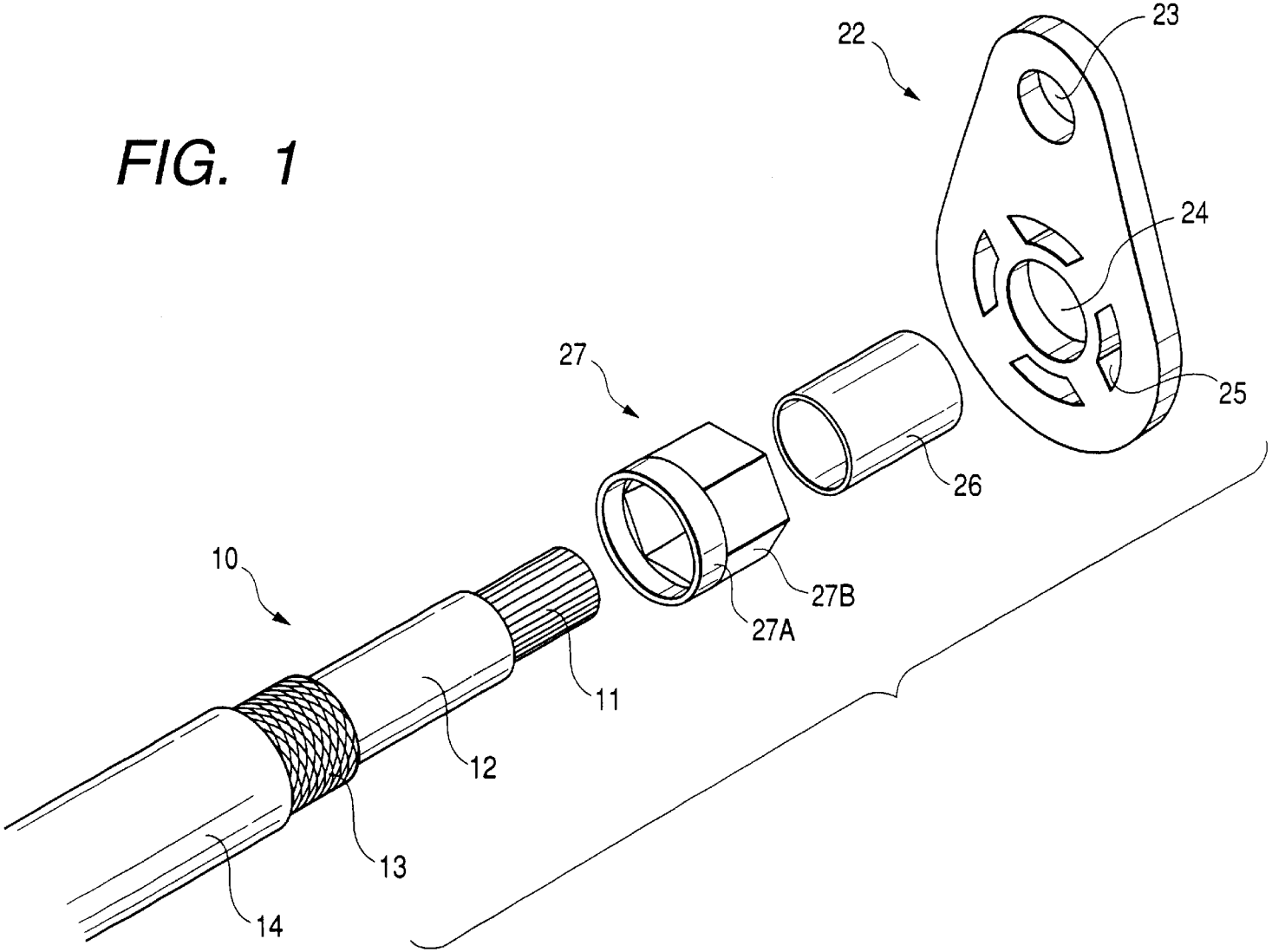
FIG. 1 is a perspective view illustrating a flange, an electrically conductive sleeve, and the like in accordance with a first embodiment of the invention.

As shown in FIG. 1, a shielding wire 10 has a core wire 11, an inner insulating layer 12, a shielding layer 13, and an outer cladding 14 in that order from the axial side, and at a terminal portion of the shielding wire 10 the core wire 11, the inner insulating layer 12, and the shielding layer 13 are consecutively exposed from the tip side.

Figure 2:
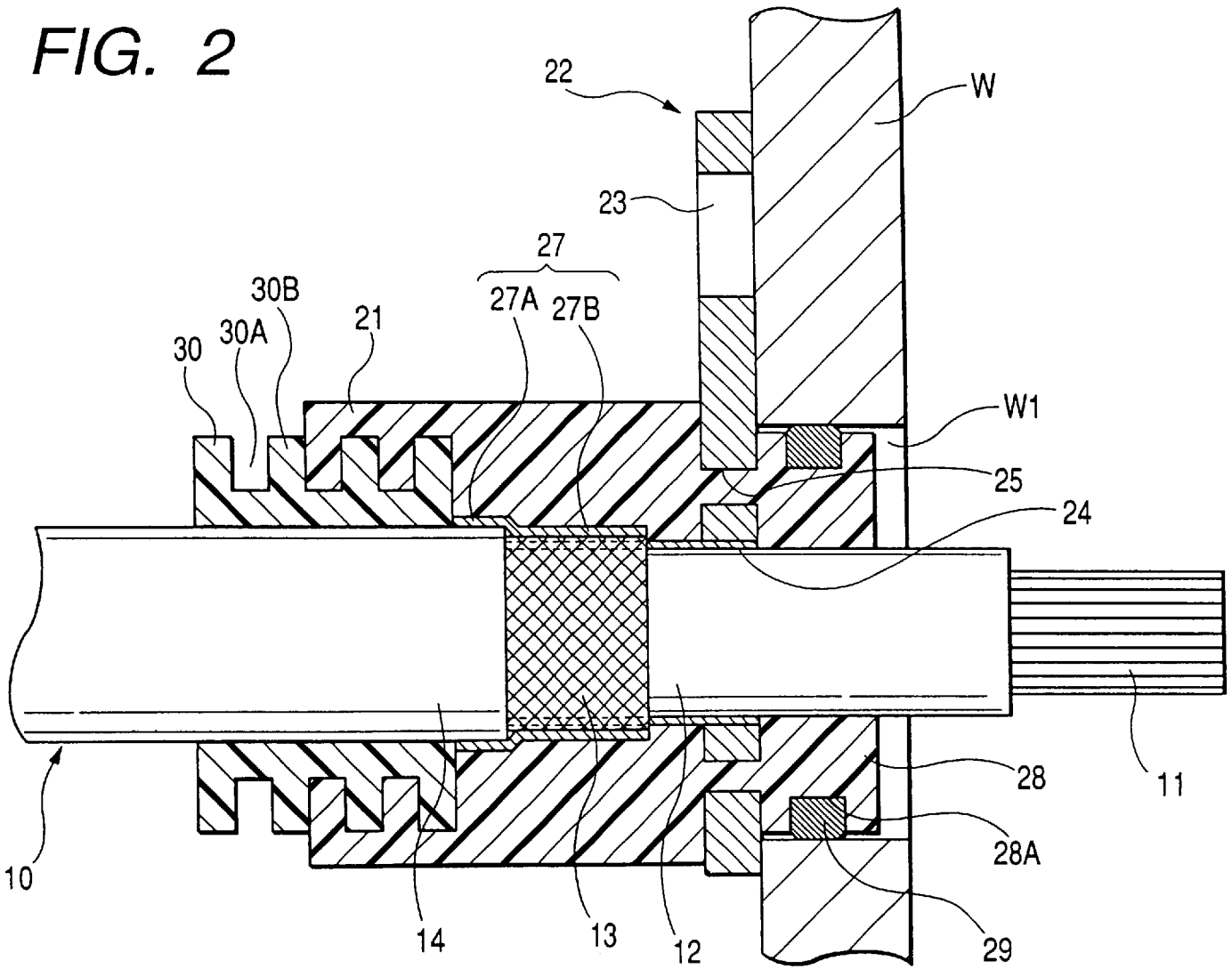
FIG. 2 is a side cross-sectional view of a shield connector in accordance with the embodiment.

As its cross-sectional shape is shown in FIG. 2, a shield connector in this embodiment is integrally attached to the terminal portion of the shielding wire 10. As shown in the drawing, the shield connector has a housing 21 made of a synthetic resin (e.g., polyamide) for covering the shielding layer 13 exposed at the terminal portion of the shielding wire 10.

The housing 21 has a metallic electrically conductive flange 22 (hereafter simply referred to as the "flange 22") jutting out laterally from its forwardly offset position. The flange 22 has a structure in which after a metallic plate is blanked into, for instance, a pear shape, a bolt inserting hole 23 is formed at a position close to one end (upper end in FIG. 1), a wire inserting hole 24 is formed at a position close to the other end, and four resin flowing-in holes 25 are formed at positions obtained by dividing a peripheral portion of the wirew inserting hole 24 into four equal parts. In addition, a metallic electrically conductive sleeve 26 (corresponding to an "electrically conductive tubular portion" in the invention) is press-fitted in the wire inserting hole 24, and this electrically conductive sleeve 26 is inserted between the shielding layer 13 and the internal insulating layer 12 in the shielding wire 10. Further, a metallic auxiliary sleeve 27 is fitted over the outer side of the shielding layer 13. More specifically, the auxiliary sleeve 27 is formed of a metal, and a hollow cylindrical portion 27A provided at one end thereof is fitted over the outer cladding 14 of the shielding wire 10, while a hexagonal tubular portion 27B provided at the other end thereof is fitted over an exposed portion of the shielding layer 13.

A front side (see FIG. 2) of the housing 21 located forwardly of the flange 22 forms an inserting portion 28 for insertion into an attaching hole W1 formed in a mating wall W, and an O-ring 29 is fitted in an annular groove 28A formed in its outer peripheral surface.

In addition, a waterproof tubular portion 30 formed of a synthetic resin (e.g., urethane) softer than the housing 21 is provided on the inner peripheral side of a rear end portion of the housing 21. A plurality of annular recesses 30A and annular projections 30B are alternately formed on an outer peripheral surface of the waterproof tubular portion 30 along the axial direction.

Figure 3A:
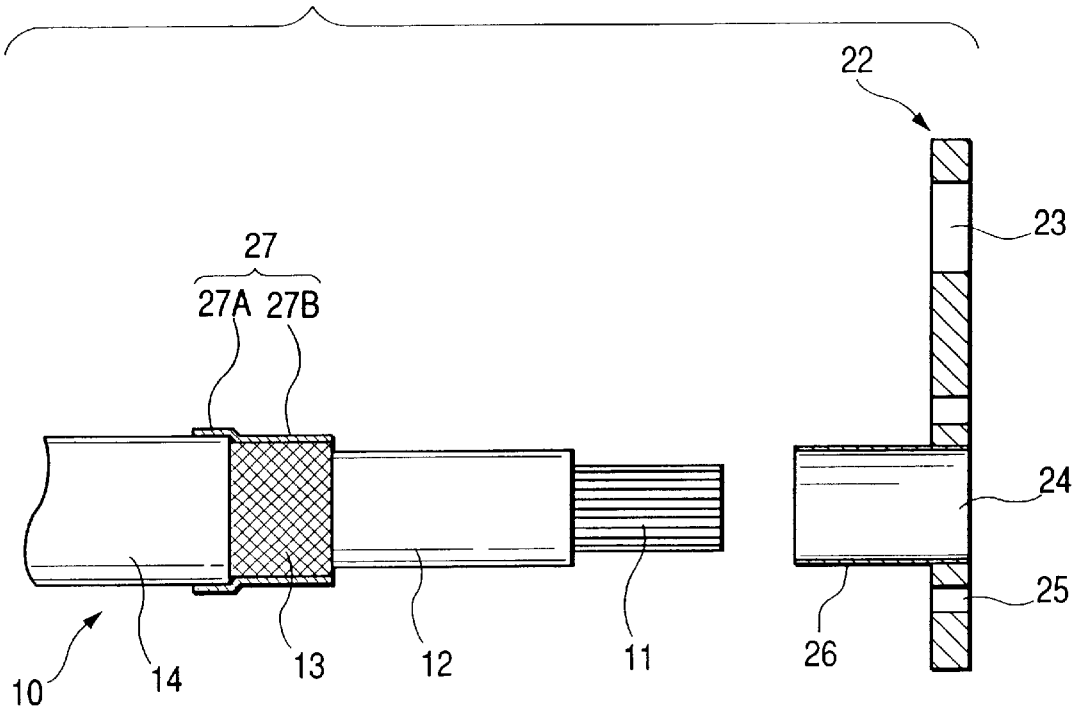
FIG. 3A is a side cross-sectional view illustrating a state prior to the assembly of the flange onto a shielding wire.
Figure 3B:
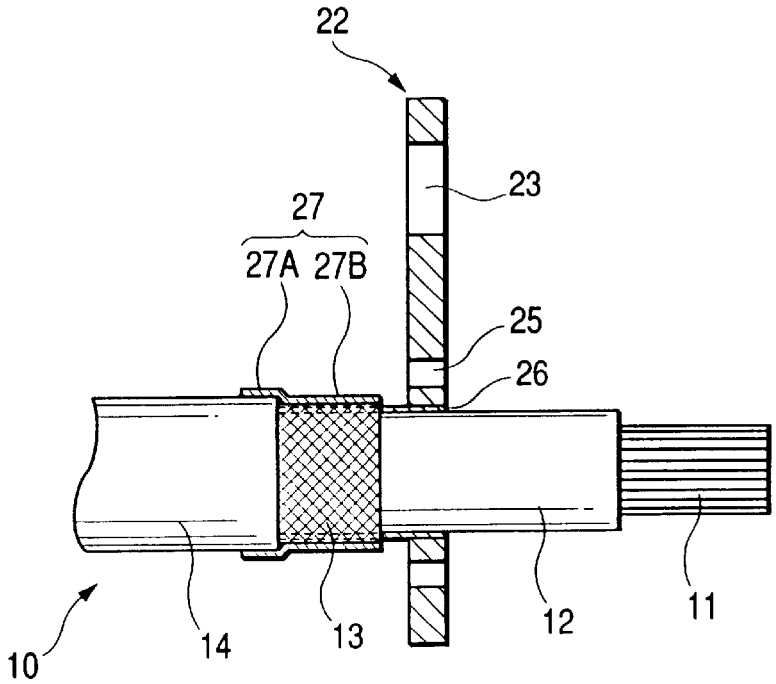
FIG. 3B is a side cross-sectional view illustrating a state in which the flange has been assembled onto the shielding wire.
Figure 5:
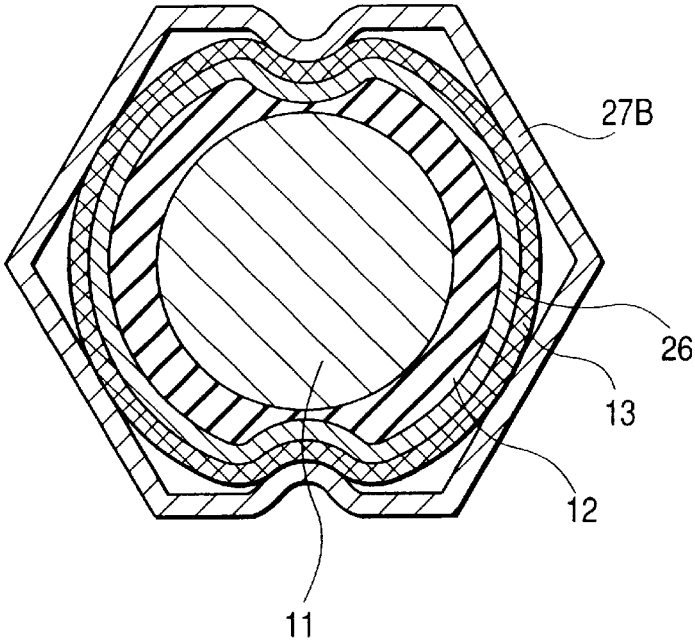
FIG. 5 is a vertical cross-sectional view illustrating a state in which,an auxiliary sleeve has been crimped.

Next, a description will be given of the step of attaching the shield connector of this embodiment to the shielding wire 10. First, as shown in FIG. 3A, the auxiliary sleeve 27 is fitted over the shielding wire 10, the hhh 27A of the auxiliary sleeve 27 is fitted over an end portion of the outer cladding 14, and the hexagonal tubular portion 27B is fitted over the shielding layer 13. Next, as shown in FIG. 3B, the electrically conductive sleeve 26 press-fitted into the flange 22 is fitted over the shielding wire 10 starting from its tip side and is inserted into the inner side of the shielding layer 13. Then, as shown in FIG. 5, the upper and lower sides of the hexagonal tubular portion 27B are crimped in such a manner as to be crushed toward the inner side. Consequently, the shielding layer 13 is clamped between the auxiliary sleeve 27 and the electrically conductive sleeve 26 and is conductingly connected to them, thereby allowing the shielding layer 13 to be conductingly connected to the flange 22 through the electrically conductive sleeve 26.

Figure 4A:
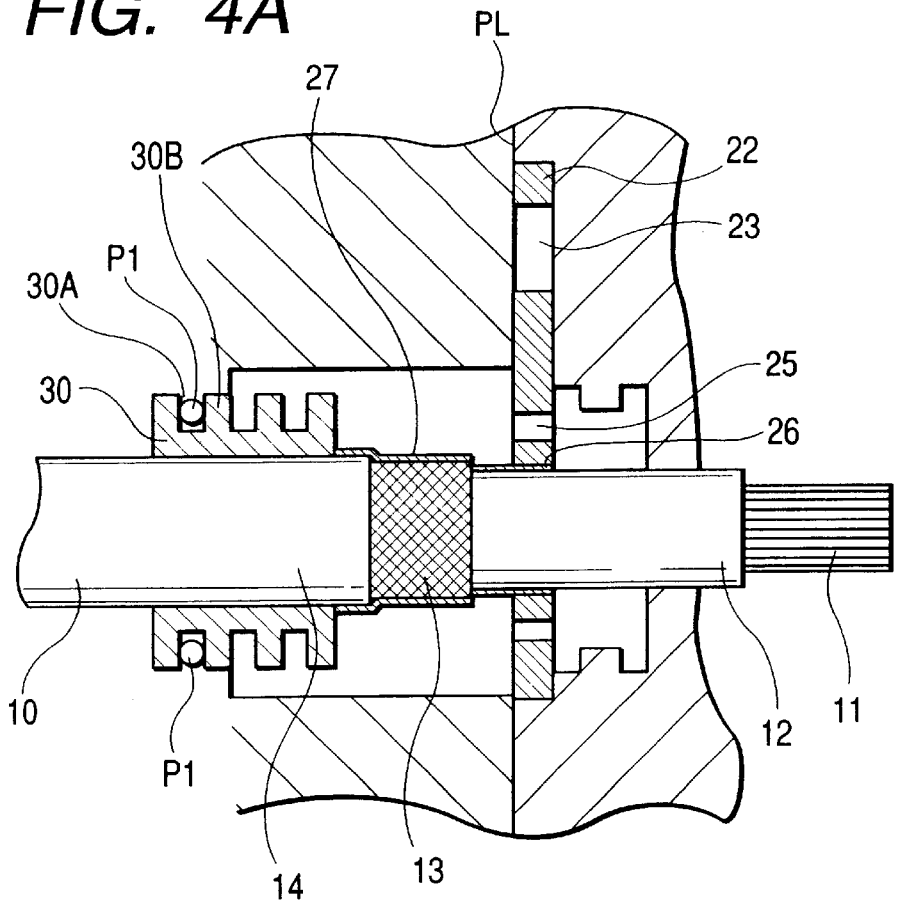
FIG. 4A is a side cross-sectional view of a state in which a terminal portion of the shielding wire has been set in a mold.
Figure 4B:
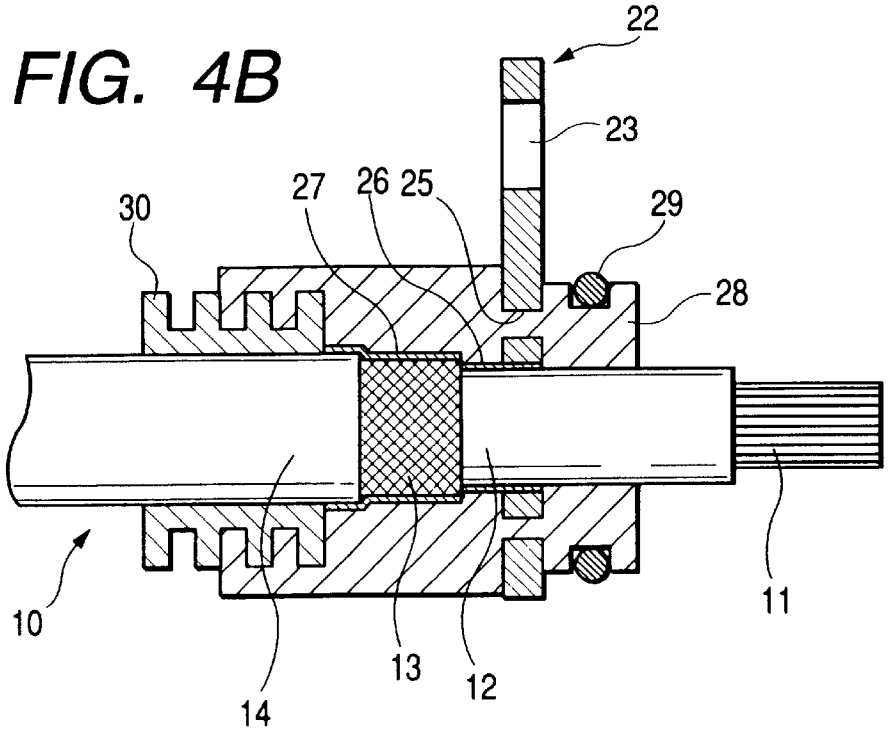
FIG. 4B is a side cross-sectional view illustrating a completed state of the shield connector.

This shielding wire 10 with the conductive flange 22 and the like attached thereto is set in a mold for a soft resin. Then, a resin (e.g., urethane) in a molten state is charged into the mold to form the waterproof tubular portion 30. Then, this waterproof tubular portion 30 is removed from the mold, and the shielding wire 10 is set in a mold for a resin of higher rigidity. At this time, as shown in FIG. 4A, a pair of pins P1 provided in the mold are inserted in the rear end-side recess 30A formed in the outer peripheral surface of the waterproof tubular portion 30, and the positions of the waterproof tubular portion 30 and the flange 22 are fixed with the flange 22 clamped at a mold opening plane PL of the mold. Then, a resin (e.g., polyamide) in a molten state is charged into the mold. Here, even if the resin is charged from the rear side (left-hand side in FIG. 4A, for example) located rearwardly of the flange 22 in the resin forming space in the mold, the resin passes through the resin flowing-in holes 25 formed in the flange 22 and spreads to the front side of the flange 22 as well, thereby forming the inserting portion 28 (see FIG. 4B) of the shield connector. Then, this molding is removed from the mold, and the O-ring 29 is fitted to the outer surface of the inserting portion 28, thereby completing the operation of assembling the shield connector and the operation of attaching the shield connector to the wire.

As shown in FIG. 2, in a state in which the inserting portion 28 is fitted in the attaching hole W1 formed in the shielding wall W of the electrical apparatus and the flange 22 abuts against the opening edge of the attaching hole W1, the shield connector is fixed to the shielding wall W by means of a bolt (not shown). Then, the flange 22 is pressed against the shielding wall W and is conductingly connected thereto, thereby allowing the shielding layer 13 to be conductingly connected to the shielding wall W. In addition, the O-ring 29 is crushed between the outer peripheral surface of the inserting portion 28 and the inner peripheral surface of the attaching hole W1 to attain waterproofing. Further, at the rear end portion of the shield connector, the waterproof tubular portion 30 formed of a synthetic resin softer than the housing 21 is brought into close contact with the inner peripheral surface of the housing 21 and the outer peripheral surface of the shielding wire 10, thereby preventing the entry of water from the rear end portion of the shield connector into the connector, Thus, according to the shield connector of this embodiment, since the arrangement provided is such that the flange 22 Which is fixed to the mating shielding wall W is made electrically conductive, and the shielding layer 13 of the shielding wire 10 is conductingly connected to the electrically conductive sleeve 26 integrally formed therewith by press-fitting, the structure for electrically conducting the shielding layer 13 and the mating shielding wall W is simplified, so that the number of parts can be reduced. Consequently, the manufacturing process is simplified, thereby making it possible to hold down the cost. In addition, it becomes possible to make the shield connector compact. In addition, in the shield connector of this embodiment, the abutting surfaces of the flange 22 and the mating shielding wall W form the conductingly connecting surfaces of the shield connector and the mating shielding wall W, so that it is possible to secure a large conducting surface than the conventional shield connector. Moreover, since the two members are brought into close contact by being tightened by the bolt, the stability of conduction between the shield connector and the mating shielding wall W increases as compared with the conventional shield connector.

<Second Embodiment>

Figure 6:
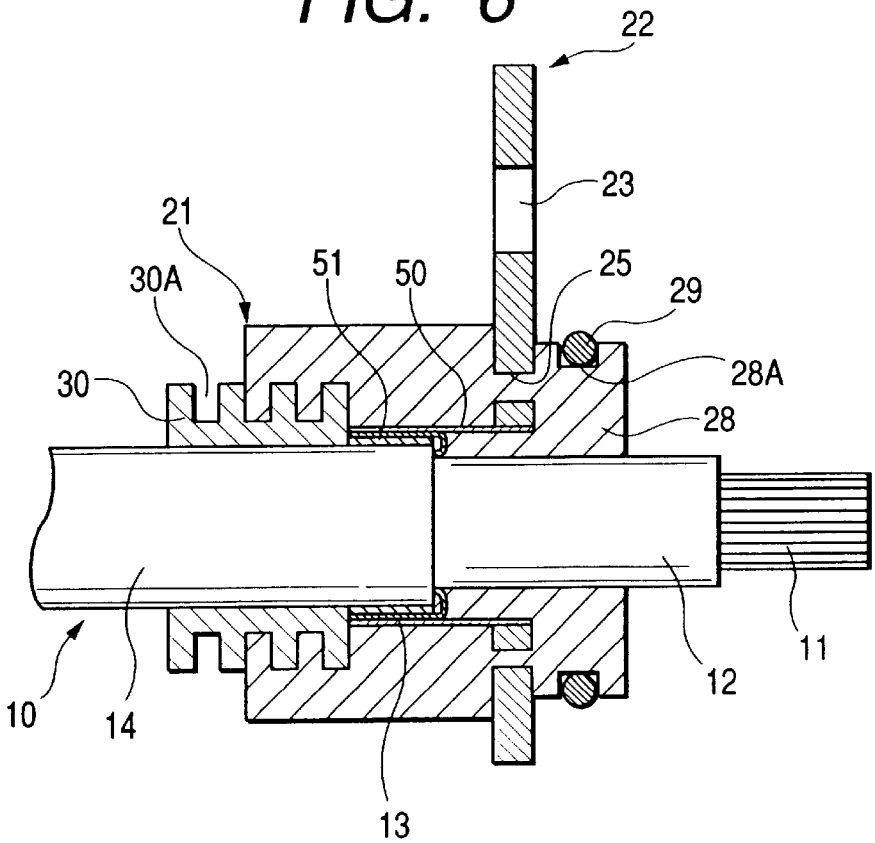
FIG. 6 is a side cross-sectional view of a shield connector in accordance with a second embodiment.
Figure 7A:
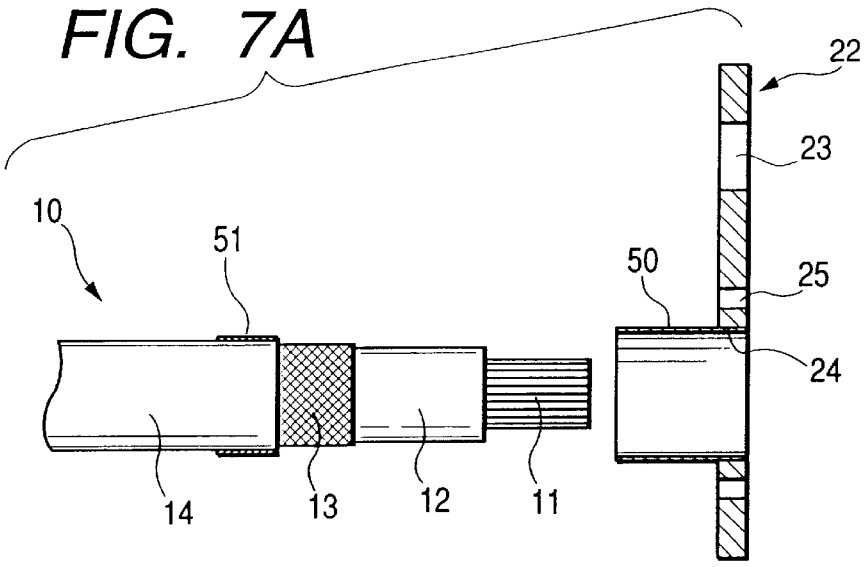
FIGS. 7A to 7C are side cross-sectional views illustrating a state in which the shield connector is in the process of being assembled.
Figure 7B:
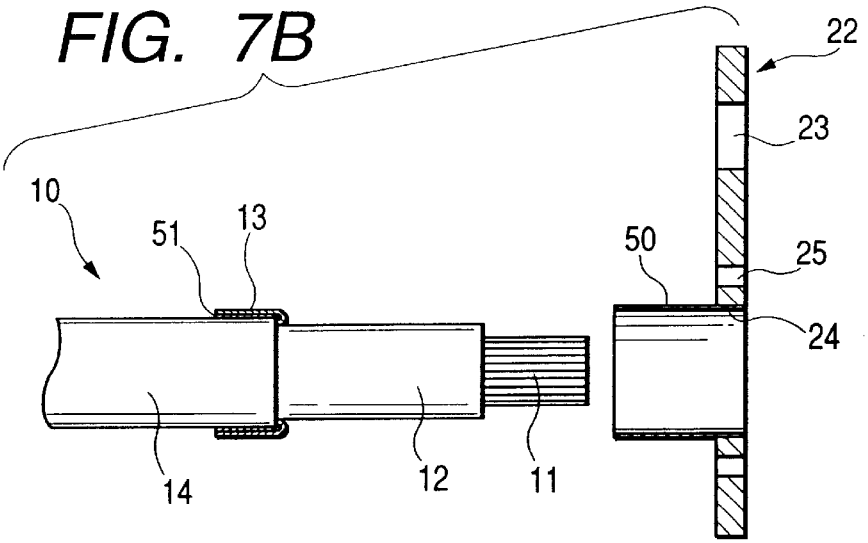
Figure 7C:
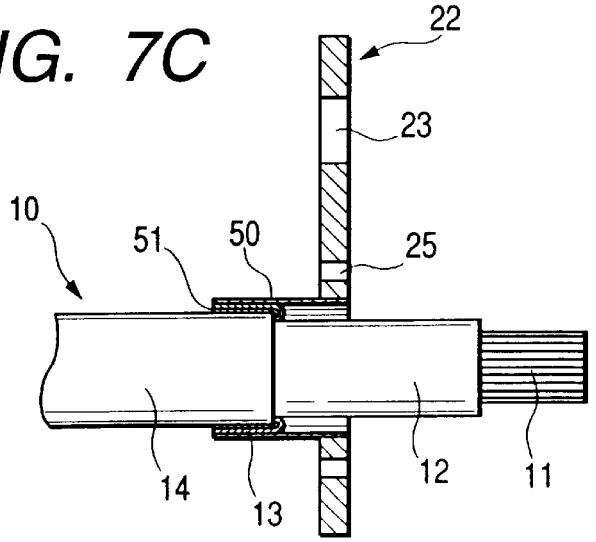

This embodiment is shown in FIGS. 6 and 7, and the arrangements of an electrically conductive sleeve 50 and an auxiliary sleeve 51 are made different from those of the above-described first embodiment. Since the other arrangements are similar to those of the above-described first embodiment, the same arrangements will be denoted by the same reference numerals, and overlapping descriptions will be omitted.

The auxiliary sleeve 51 in this embodiment has a hollow cylindrical shape, and is fitted over the outer cladding 14 of the shielding wire 10, as shown in FIG. 7A. Then, as shown in FIG. 7B, after the shielding layer 13 is turned back so as to be set in a state of covering the outer side of the auxiliary sleeve 51, if the electrically conductive sleeve 50 is fitted over the shielding wire 10, the electrically conductive sleeve 50 is fitted over the outer side of the shielding layer 13, with the result that the shielding layer 13 is placed between the auxiliary sleeve 51 and the electrically conductive sleeve 50. Subsequently, the waterproof tubular portion 30 and the housing 21 are molded in the same way as in the first embodiment, thereby completing the shield connector of this embodiment (see FIG. 6). By adopting such an arrangement, it is possible to obtain similar operation and effects similar to those of the above-described first embodiment.

<Third Embodiment>

Next, referring to FIGS. 8 and 9, a description will be given of a third embodiment of the invention.

In a shield connector 60 in this embodiment, three shielding wires 10 are integrally connected by using one housing 61 and one electrically conductive flange 62 (as its material, it is possible to cite copper, copper alloy, iron, stainless steel, and the like). It should be noted that since the shielding wires 10, and the electrically conductive sleeves 26 (corresponding to an "electrically conductive member" in the invention) and the auxiliary sleeves 27 which are used for attachment of the shielding wires 10 to the shield connector 60 are the same as those used in the above-described embodiment, these members will be denoted by the same reference numerals.

The electrically conductive flange 62 has a plate shape which is elongated in the left and right direction as a whole, three circular wire inserting holes 63 are penetratingly formed at fixed pitches in the left and right direction, and a pair of bolt inserting holes 64 are penetratingly formed at opposite end positions sandwiching these three wire inserting holes 63. Circumferentially divided, arcuate resin flowing-in holes 65 are formed around respective peripheral edge portions of the wire inserting holes 63. The circular metallic electrically conductive sleeve 26 is press-fitted in each of the wire inserting holes 63, and each electrically conductive sleeve 26 is inserted between the shielding layer 13 and the inner insulating layer 12 of the shielding wire 10. In addition, the metallic auxiliary sleeve 27 is fitted over the outer periphery of each shielding layer 13.

Figure 8:
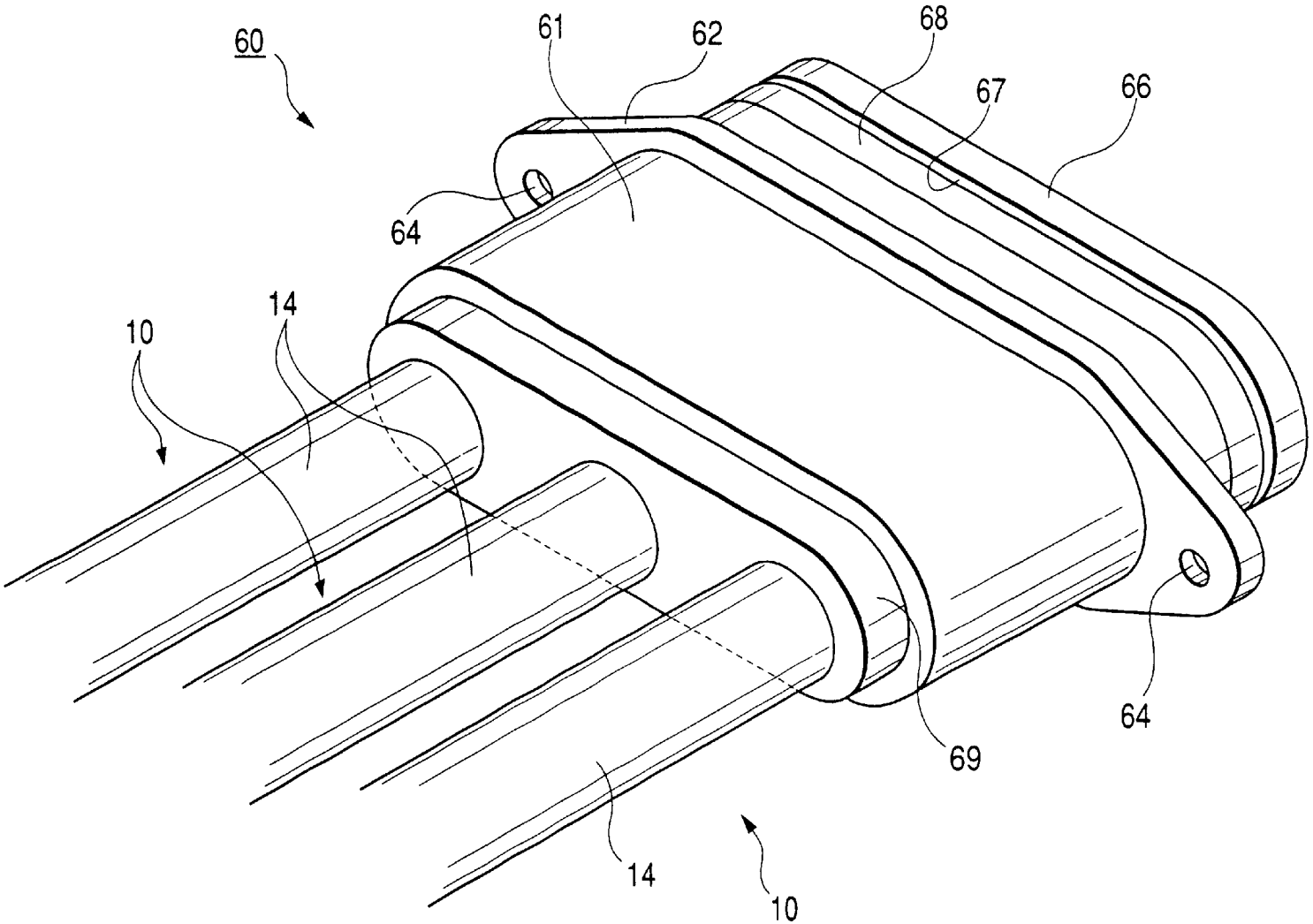
FIG. 8 is a perspective view of a third embodiment.
Figure 9:
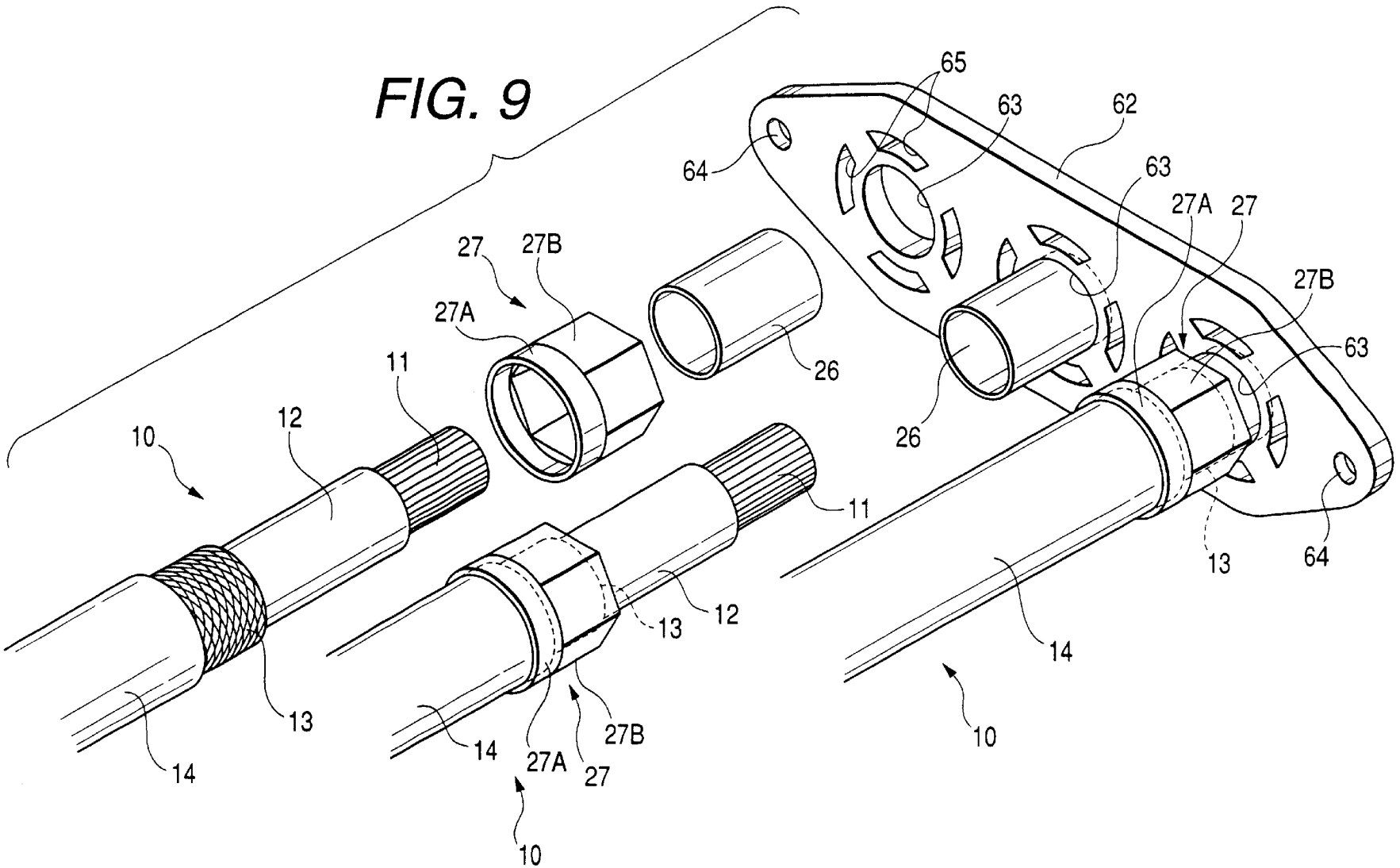
FIG. 9 is a perspective view of a state in which the shield connector is in the process of being assembled.

In addition, the housing 61 has a transversely elongated oval shape as viewed in the axial direction of the shielding wire 10, and that portion of the housing 61 which juts out toward the front side (the upper right side in FIGS. 8 and 9) forwardly of the electrically conductive flange 62 is formed as an oval inserting portion 66 which is inserted into the attaching hole W1 of the mating shielding wall W (not shown in FIGS. 8 and 9). An O-ring 68 is fitted in a groove 67 formed in an outer periphery of this inserting portion 66. An oval waterproofing portion 69 formed of a synthetic resin (e.g., urethane) which is softer than the housing 61 is provided on the inner peripheral side of a rear end portion of the housing 61.

Next, a description will be given of the step of assembling the shield connector 60 and the shielding wires 10 in accordance with this embodiment. First, in the same way as in the first embodiment, the auxiliary sleeves 27 are fitted over the respective shielding wires 10, and the electrically conductive sleeves 26 are press-fitted in the respective wire inserting holes 63 (see the shielding wire 10 and the wire inserting hole 63 in the middle in FIG. 9). Next, a tip portion of each shielding wire 10 is inserted into the electrically conductive sleeve 26, and the rear end portion of each electrically conductive sleeve 26 is inserted between the shielding layer 13 and the inner insulating layer 12 (see the shielding wire 10 and the wire inserting hole 63 on the right-hand side in FIG. 9). Then, the hexagonal tubular portion 27B of each auxiliary sleeve 27 is crimped against the shielding wire 10, thereby allowing the shielding layer 13 and the electrically conductive flange 62 to be conductingly connected to each other through the electrically conductive sleeve 26.

The subassembly of the electrically conductive flange 62 and the like with the three shielding wires 10 thus attached thereto is set in a mold for a soft resin, and a molten resin is charged into the mold, thereby molding the waterproofing portion 69. Then, the molded piece is removed from the mold, is set in a mold for a resin having higher regidity, and a molten resin (e.g., polyamide) is charged into the mold, thereby molding the housing 61 and the inserting portion 66. After molding, the molded piece is removed from the mold, and the O-ring 68 is fitted to the inserting portion 66. This completes the connection of the three shielding wires 10 to the shield connector 60.

Since the three shielding wires 10 are collectively connected to one shield connector 60 in this embodiment, this arrangement is suitable for a three-phase ac circuit, for example. In addition, as compared with the structure in which the shielding wires 10 are individually connected to the shield connector one piece at a time, it is possible to reduce the number of parts, decrease the number of assembling steps, and make the overall shield connector 60 compact.

It should be noted that although, in this embodiment, the waterproofing portion 69 formed of a soft resin is provided on the inner periphery of the rear end portion of the housing 61, it is possible to adopt a structure which is not provided with the waterproofing portion. As the resin material of the housing 61 in this case, it is possible to use urethane, PBT, nylon, and the like.

<Other Embodiments>

The present invention is not limited to the above-described embodiments. For example, embodiments which are described below are also included within the technical scope of the invention, and in addition to the embodiments described below various modifications may be made within the scope which does not depart from the gist.

(1) It is possible to adopt an arrangement in which the auxiliary sleeve 27 in the above-described first embodiment is not provided, and the shielding layer 13 of the shielding wire 10 is fused to the electrically conductive sleeve 26. If this arrangement is adopted, the number of parts can be further reduced.

(2) Although the flange 22 is formed by blanding a metallic plate, the flange 22 may be formed by plating, for example, a resin with an electrically conductive metal.

(3) Although the electrically conductive sleeve 26 in the above-described first embodiment is formed integrally with the flange 22 by press-fitting, the flange 22 and the electrically conductive sleeve 26 may be formed integrally, for instance, by an electrically conductive adhesive agent or by welding, or the electrically conductive sleeve may be formed integrally with the flange 22 by a deep-drawing press.

<Fourth Embodiment>

Referring next to FIGS. 10 to 13, a description will be given of a fourth embodiment of the invention.

Figure 10:
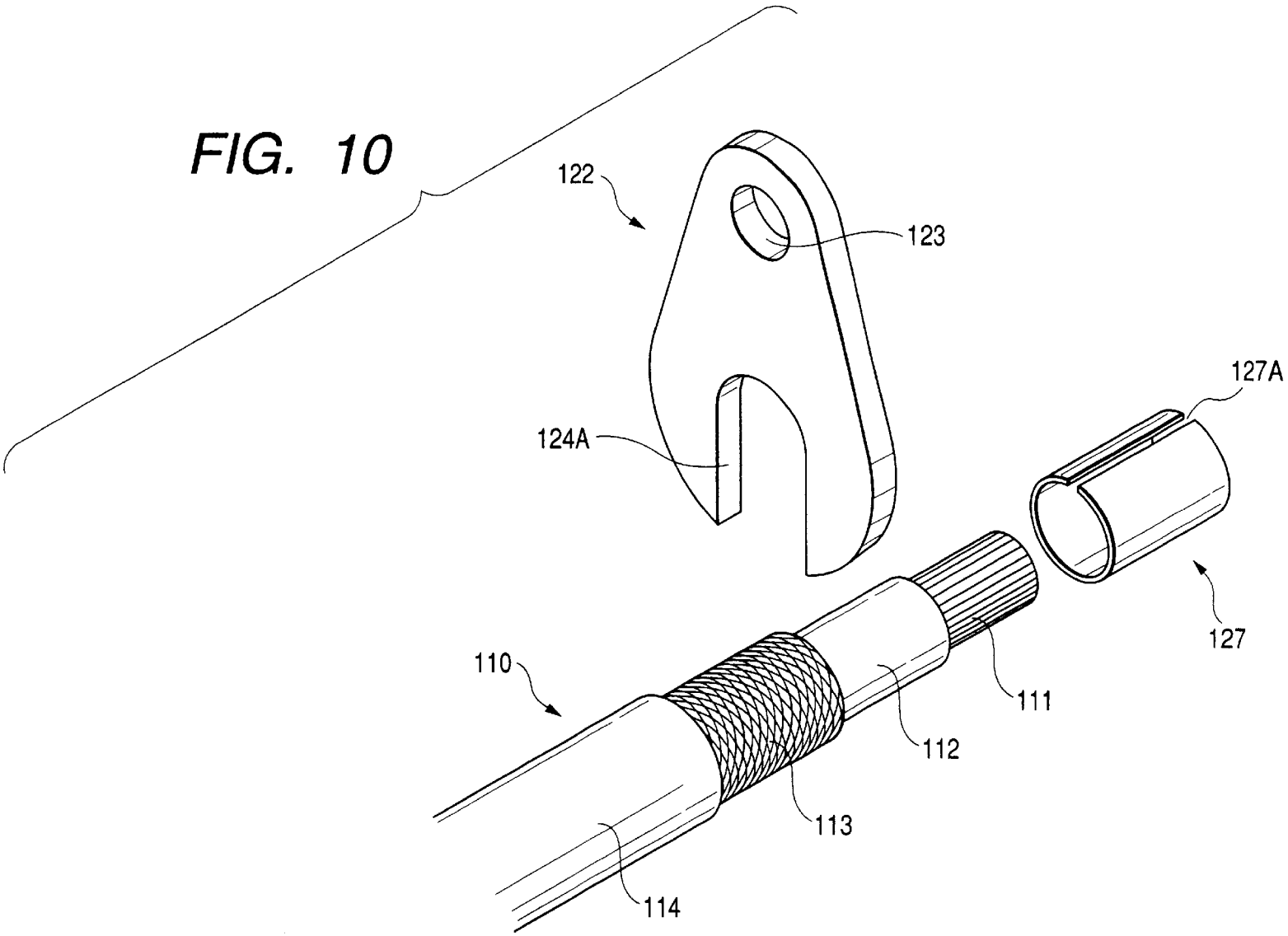
FIG. 10 is a perspective view illustrating a shielding wire and a flange in accordance with a first embodiment of the invention.

As shown in FIG. 10, a shielding wire 110 has a core wire 111, an inner insulating layer 112, a shielding layer 113, and an outer cladding 114 in that order from the axial side, and at a terminal portion of the shielding wire 110 the core wire 111, the inner insulating layer 112, and the shielding layer 113 are consecutively exposed from the tip side.

Figure 11:
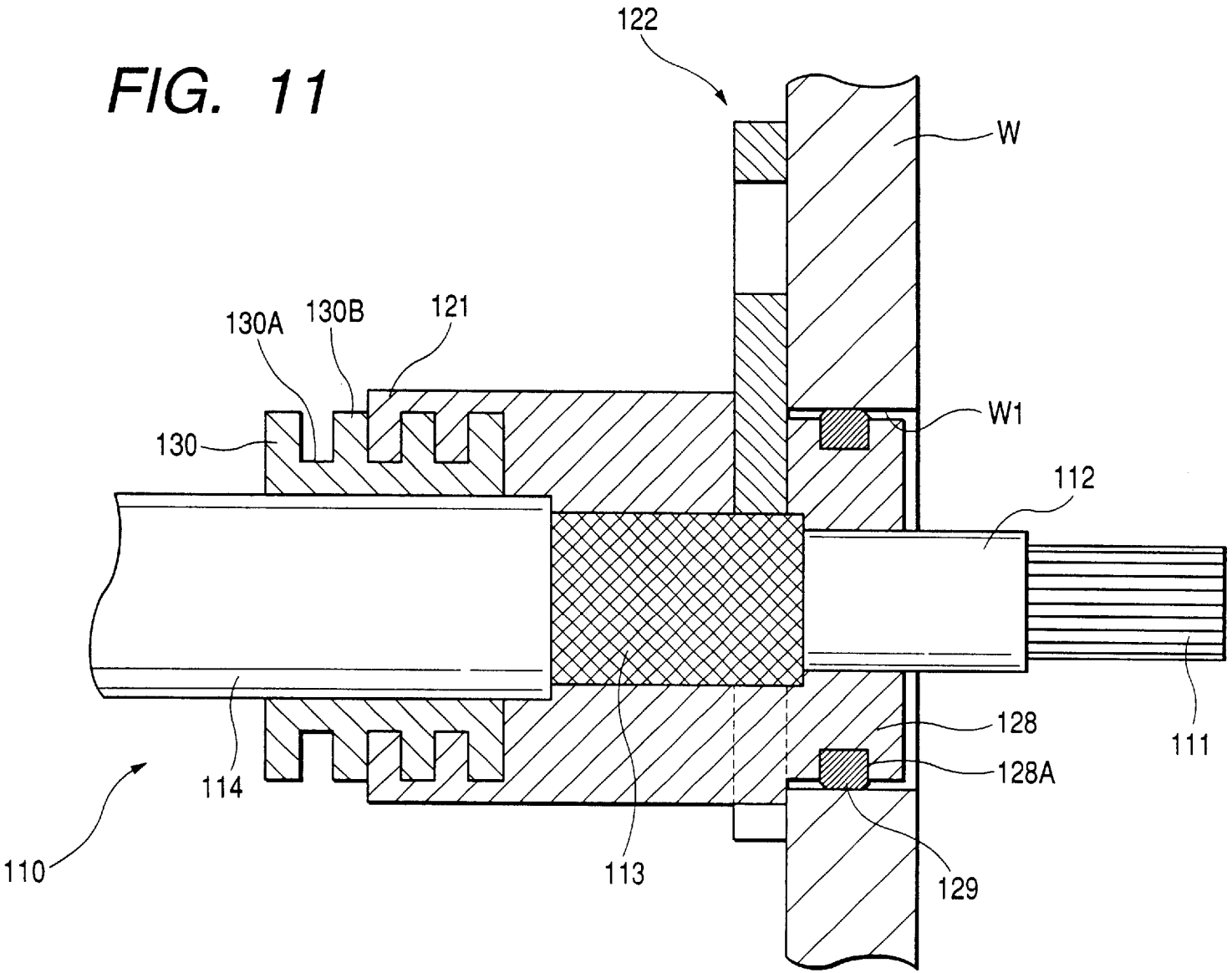
FIG. 11 is a side cross-sectional view of a shield connector in accordance with the embodiment.

As its cross-sectional shape is shown in FIG. 11, a shield connector in this embodiment is integrally attached to the terminal portion of the shielding wire 110. As shown in the drawing, the shield connector has a housing 121 made of a synthetic resin (e.g., polyamide) for covering the shielding layer 113 exposed at the terminal portion of the shielding wire 110.

The housing 121 has a metallic electrically conductive flange 122 (hereafter simply referred to as the "flange 122")

jutting out laterally from its forwardly offset position. The flange 122 is formed by blanking a metallic plate, and as a whole has a pear-shaped configuration, as shown in FIG. 10. Additionally, a bolt inserting hole 123 is formed at a position close to its upper end, while a U-shaped slot portion 124 is formed in its lower side. The U-shaped slot portion 124 is open at the lower end of the flange 122, and a curved surface 124A in its innermost portion has a curvature capable of being brought into close contact with an outer surface of the shielding layer 113.

In addition, an inner sleeve 127 is fitted on the inner side of the exposed portion of the shielding layer 113. As shown in FIG. 10, the inner sleeve 127 has a vertical slit 127A formed in a peripheral portion of a metallic tube, and is resiliently deformable in the radial direction.

A front side (see FIG. 11) of the housing 121 located forwardly of the flange 122 forms an inserting portion 128 for insertion into an attaching hole W1 formed in a mating wall W, and an O-ring 129 is fitted in an annular groove 128A formed in its outer peripheral surface.

In addition, a waterproof tubular portion 130 formed of a synthetic resin (e.g., urethane) softer than the housing 121 is provided on the inner peripheral side of a rear end portion of the housing 121. A plurality of annular recesses 130A and annular projections 130B are alternately formed on an outer peripheral surface of the waterproof tubular portion 130 along the axial direction.

Next, a description will be given of the step of attaching the shield connector of this embodiment to the shielding wire 110.

Figure 13:
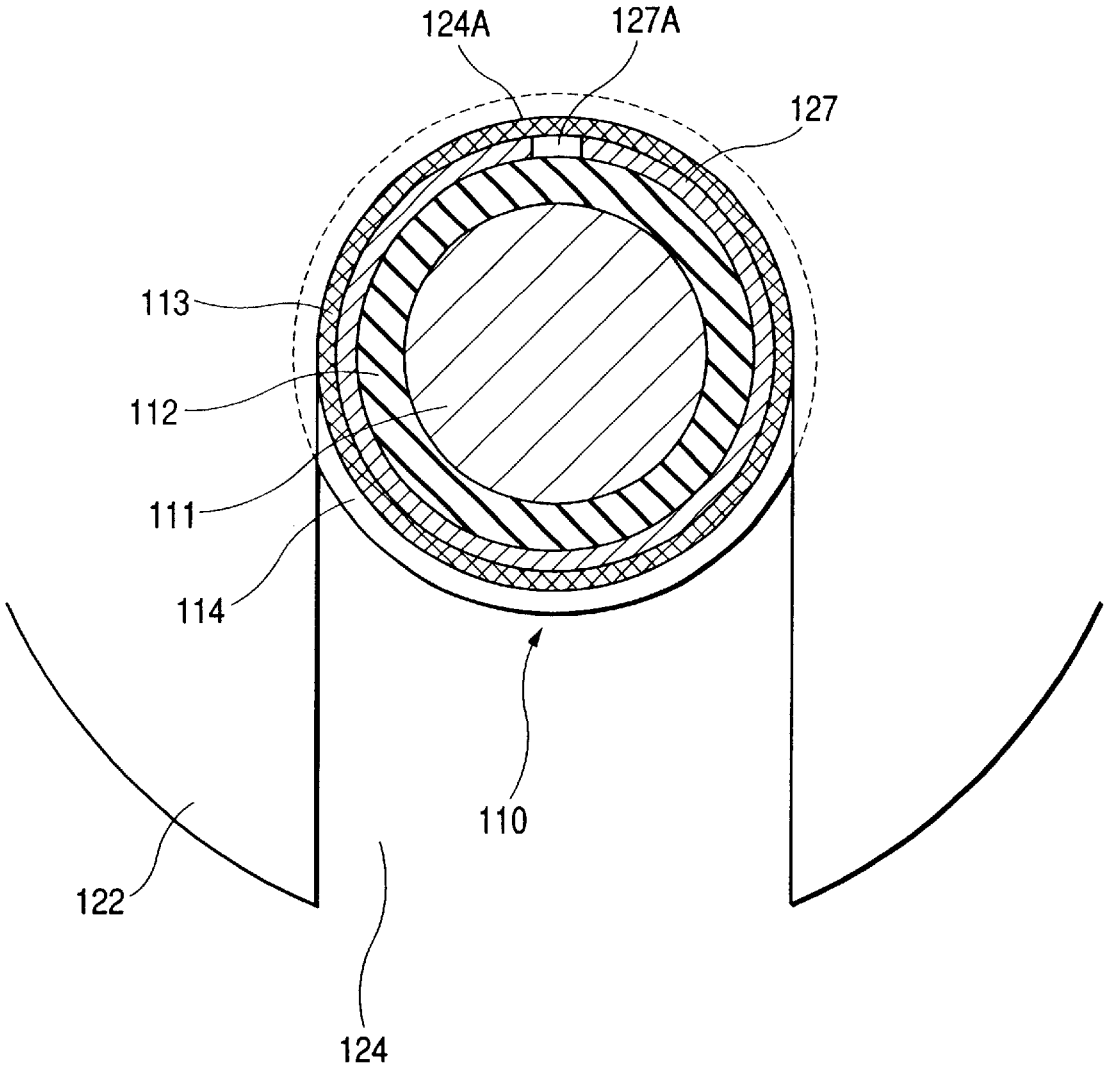
FIG. 13 is a vertical cross-sectional view illustrating a state of connection between a U-shaped slot portion and a shielding layer.

First, the inner sleeve 127 is inserted between the shielding layer 113 and the inner insulating layer 112 in the shielding wire 110. Then, the open end of the U-shaped slot portion 124 in the flange 122 is applied to the exposed portion of the shielding layer 113 of the shielding wire 110 from a lateral direction, thereby causing the flange 122 to be pressed against the shielding wire 110. Then, as shown in FIG. 13, the shielding layer 113 is brought into close contact with the curved surface 124A in the innermost portion of the U-shaped slot portion 124 and is conductingly connected thereto. Here, when the shielding wire 110 is pressed into the U-shaped slot portion 124, the inner sleeve 127 disposed on the inner side of the shielding layer 113 undergoes reduction in its diameter and is deformed. Owing to its resiliency, the shielding layer 113 is strongly pressed against the inner surface of the U-shaped slot portion 124, thereby allowing the shielding layer 113 to be conductingly connected to the flange 122 reliably.

Figure 12A:
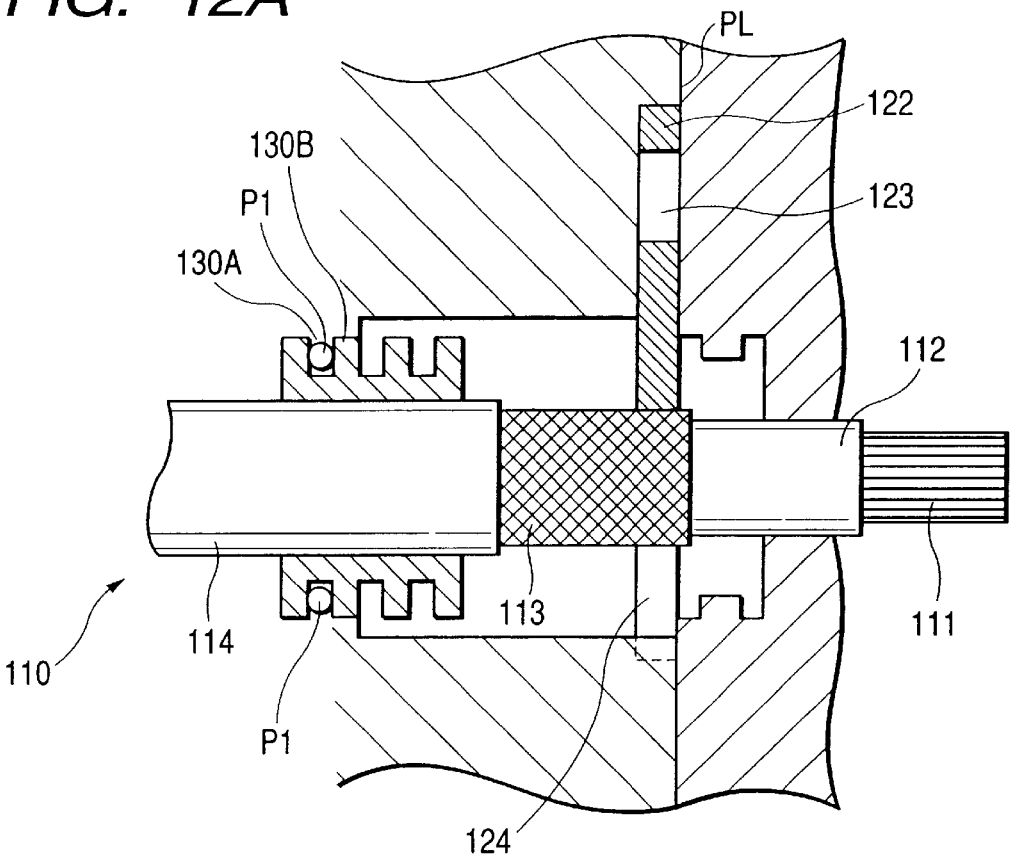
FIG. 12A is a side cross-sectional view of a state in which a terminal portion of the shielding wire is set in a mold.
Figure 12B:
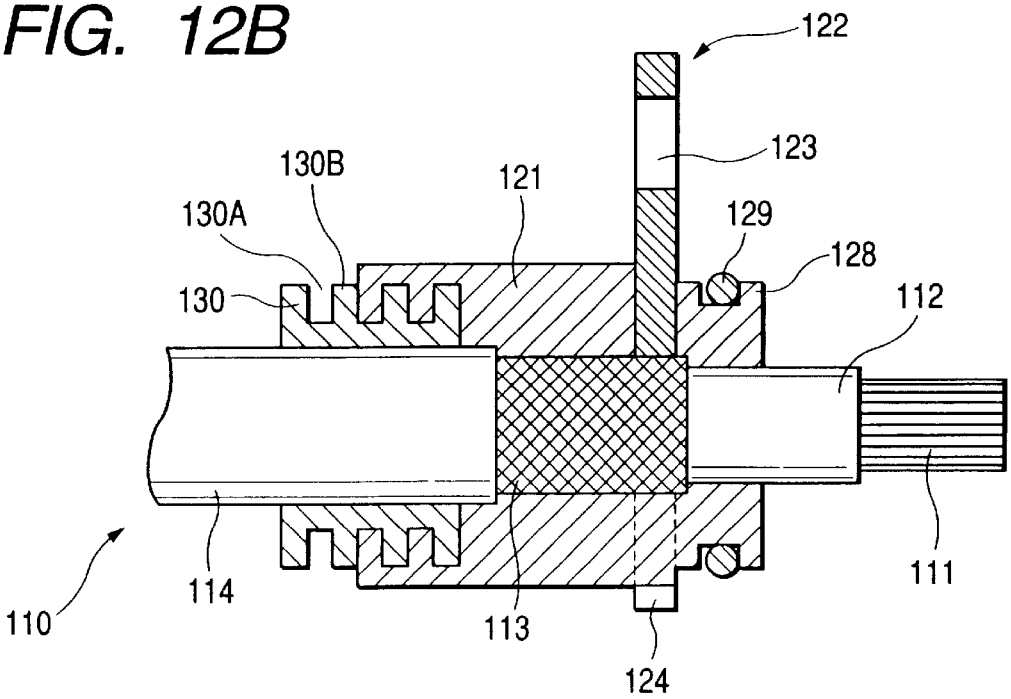
FIG. 12B is a side cross-sectional view illustrating a completed state of the shield connector.

This shielding wire 110 with the conductive flange 122 attached thereto is set in a mold for a soft resin. Then, a resin (e.g., urethane) in a molten state is charged into the mold to form the waterproof tubular portion 130. Then, this waterproof tubular portion 130 is removed from the mold, and the shielding wire 110 is set in a mold for a resin of higher rigidity. At this time, as shown in FIG. 12A, a pair of pins P1 provided in the mold are inserted in the rear end-side recess 130A formed in the outer peripheral surface of the waterproof tubular portion 130, and the positions of the waterproof tubular portion 130 and the flange 122 are fixed with the flange 122 clamped at a mold opening plane PL of the mold. Then, a resin (e.g., polyamide) in a molten state is charged into the mold. Here, even if the resin is charged from the rear side (left-hand side in FIG. 12A, for example) located rearwardly of the flange 122 in the resin forming space in the mold, the molten resin passes through the open end side of the U-shaped slot portion 124 formed in the flange 122 and spreads to the front side of the flange 122 as well, thereby forming the inserting portion 128 (see FIG. 12B) of the shield connector. Then, this molding is removed from the mold, and the O-ring 129 is fitted to the outer surface of the inserting portion 128, thereby completing the operation of assembling the shield connector and the operation of attaching the shield connector to the wire.

As shown in FIG. 11, in a state in which the inserting portion 128 is fitted in the attaching hole W1 formed in the shielding wall W of the electrical apparatus and the flange 122 abuts against the opening edge of the attaching hole W1, the shield connector is fixed to the shielding wall W1 by means of a bolt (not shown). Then, the flange 122 is pressed against the shielding wall W and is conductingly connected thereto, thereby allowing the shielding layer 113 to be conductingly connected to the shielding wall W. In addition, the O-ring 129 is crushed between the outer peripheral surface of the inserting portion 128 and the inner peripheral surface of the attaching hole W1 to attain waterproofing. Further, at the rear end portion of the shield connector, the waterproof tubular portion 130 formed of a synthetic resin softer than the housing 121 is brought into close contact with the inner peripheral surface of the housing 121 and the outer peripheral surface of the shielding wire 110, thereby preventing the entry of water from the rear end portion of the shield connector into the connector, Thus, according to the shield connector of this embodiment, since the flange 122 which is fixed to the mating shielding wall W is made electrically conductive, and the shielding layer 113 is directly conductingly connected to this flange 122, the structure for electrically conducting the shielding layer 113 and the mating shielding wall W is simplified, so that the number of parts can be reduced. Moreover, since the flange 122 is attached from the lateral direction of the shielding wire 110, the attaching operation is facilitated as compared with an arrangement in which the flange 122 is attached along the axial direction of the shielding wire 110. For these reasons, the manufacturing process is simplified, thereby making it possible to hold down the cost. In the shield connector of this embodiment, the abutting surfaces of the flange 122 and the mating shielding wall W form the conductingly connecting surfaces of the shield connector and the mating shielding wall W, so that it is possible to secure a large conducting surface than the conventional shield connector. Moreover, since the two members are brought into close contact by being tightened by the bolt, the conduction between the shield connector and the mating shielding wall W increases as compared with the conventional shield connector.

<Fifth Embodiment>

Figure 14:
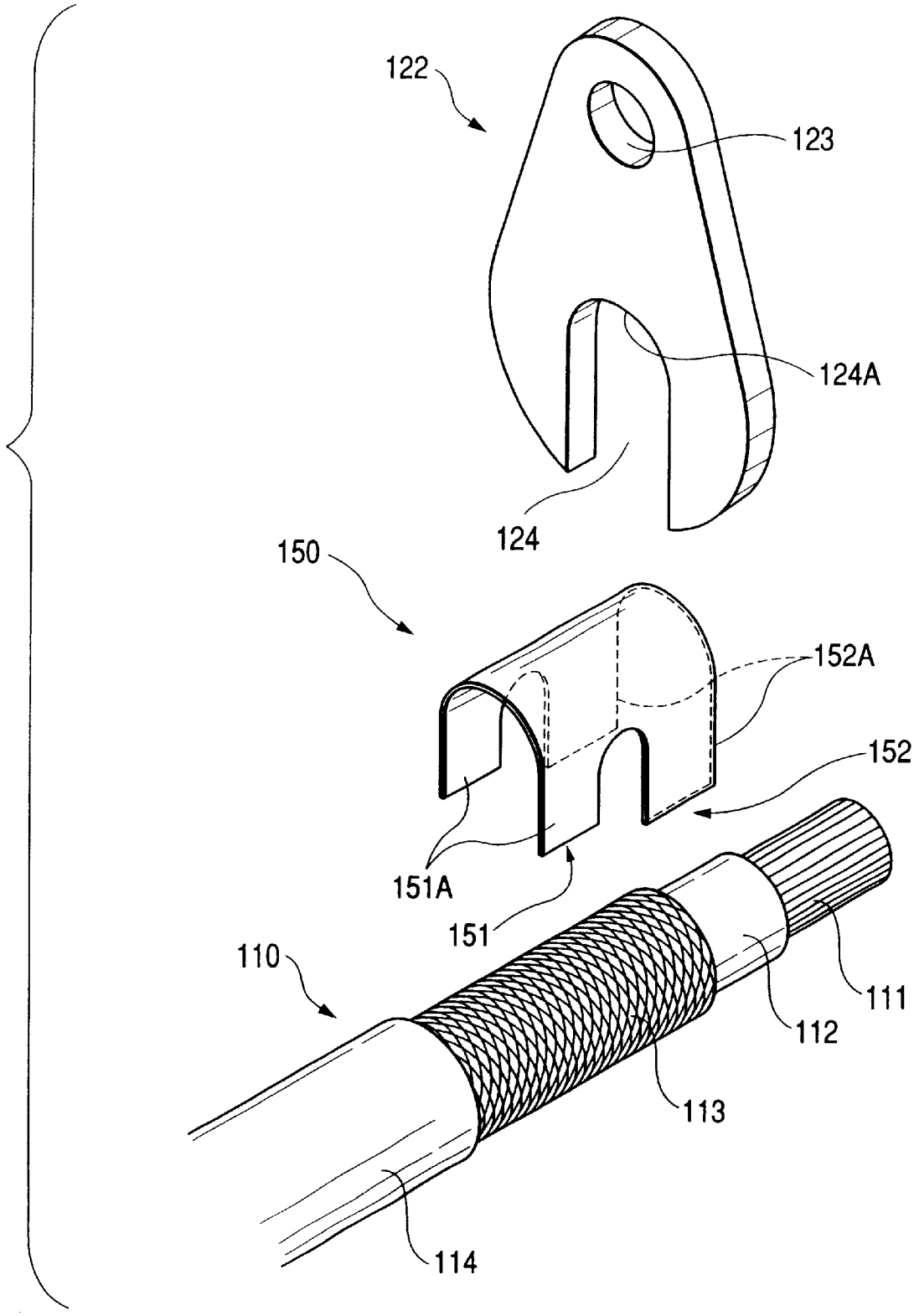
FIG. 14 is a perspective view illustrating a flange and an auxiliary barrel in accordance with a second embodiment.
Figure 15:
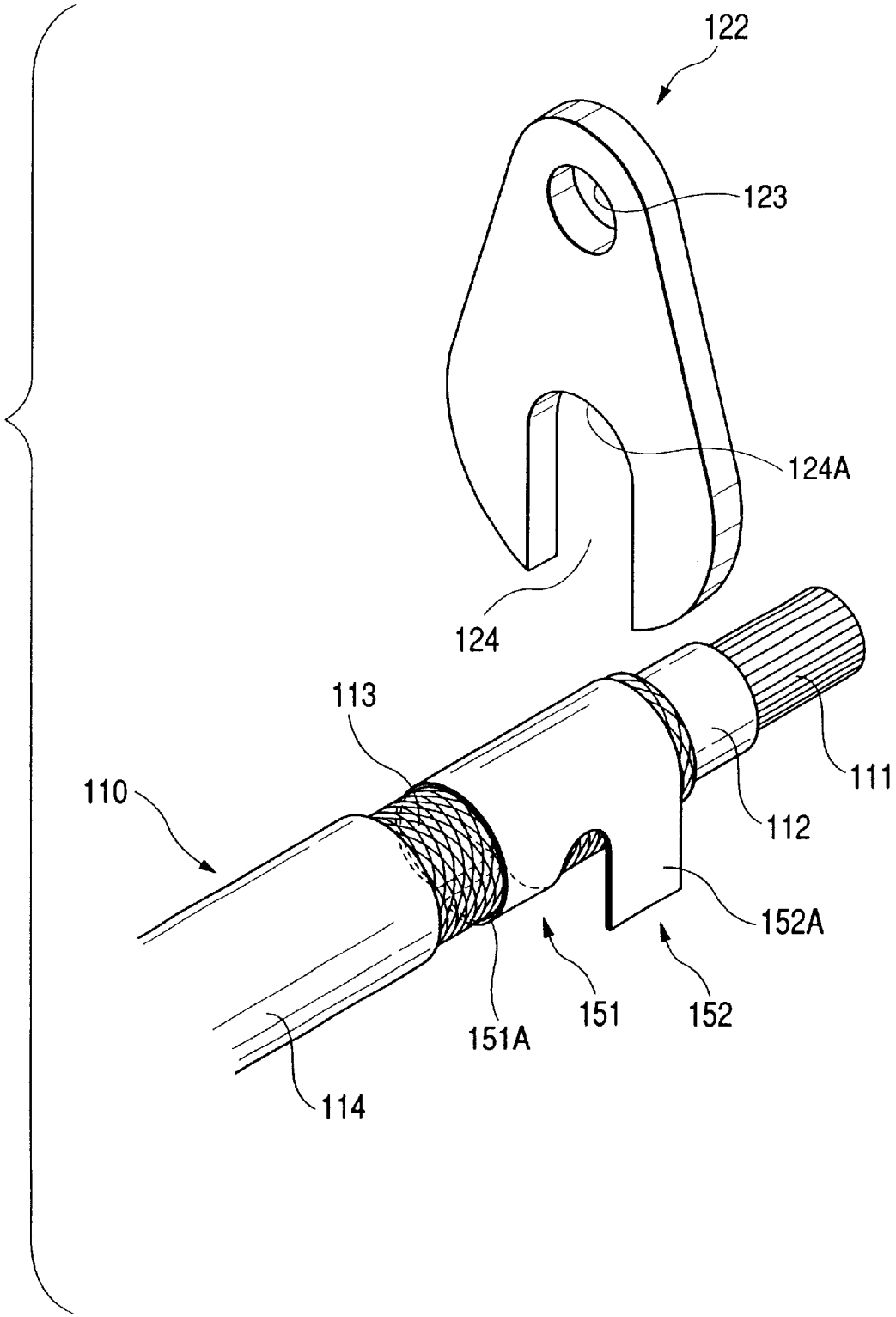
FIG. 15 is a perspective view illustrating a state in which the auxiliary barrel is crimped onto the shielding wire.

This embodiment is shown in FIGS. 14 and 15, and an auxiliary barrel 150 is provided instead of the inner sleeve in the above-described fourth embodiment. Since the other arrangements are similar to those of the above-described fourth embodiment, the same arrangements will be denoted by the same reference numerals, overlapping descriptions will be omitted, and only the different arrangement will be described below.

The auxiliary barrel 150 in this embodiment is formed by blanking a metallic plate and by being curved in a U-shape, and as a whole has a barrel-shaped configuration extending along the shielding wire 110. Further, one end side of the auxiliary barrel 150 is formed as a crimping portion 151 for the shielding wire 110, and a pair of crimping pieces 151A respectively extending from, U-shaped opposing walls are provided on that side of the crimping portion 151. In addition, the other end side of the auxiliary barrel 150 is formed as a U-shaped curved portion 152 which is conductingly connected to the inner surface of the U-shaped slot portion 124 of the flange 122, and a pair of contact pieces 152A which similarly extend from the U-shaped opposing walls are longer than the aforementioned crimping pieces 151A are provided on that side of the U-shaped curved portion 152.

When the shield connector of this embodiment is attached to the shielding wire 110, the auxiliary barrel 150 is first applied to the shielding layer 113 from a lateral direction to cause the shielding layer 113 to be brought into close contact with the curved portion of the auxiliary barrel 150. The crimping pieces 151A are then bent toward the shielding layer 113 side and are crimped. Next, the U-shaped curved portion 152 of the auxiliary barrel 150 is pressed from its curved side into the U-shaped slot portion 124 formed in the flange 122. Then, the outer surface of the U-shaped curved portion 152 is brought into the substantially entire inner surface of the auxiliary barrel 150. Consequently, the flange 122 is conductingly connected to the shielding layer 113 through the auxiliary barrel 150. Subsequently, the waterproof tubular portion 130 and the housing 121 are molded in the same way as in the fourth embodiment, thereby completing the shield connector of this embodiment. By adopting such an arrangement, it is possible to obtain similar operation and effects similar to those of the above-described fourth embodiment.

<Sixth Embodiment>

Figure 16:
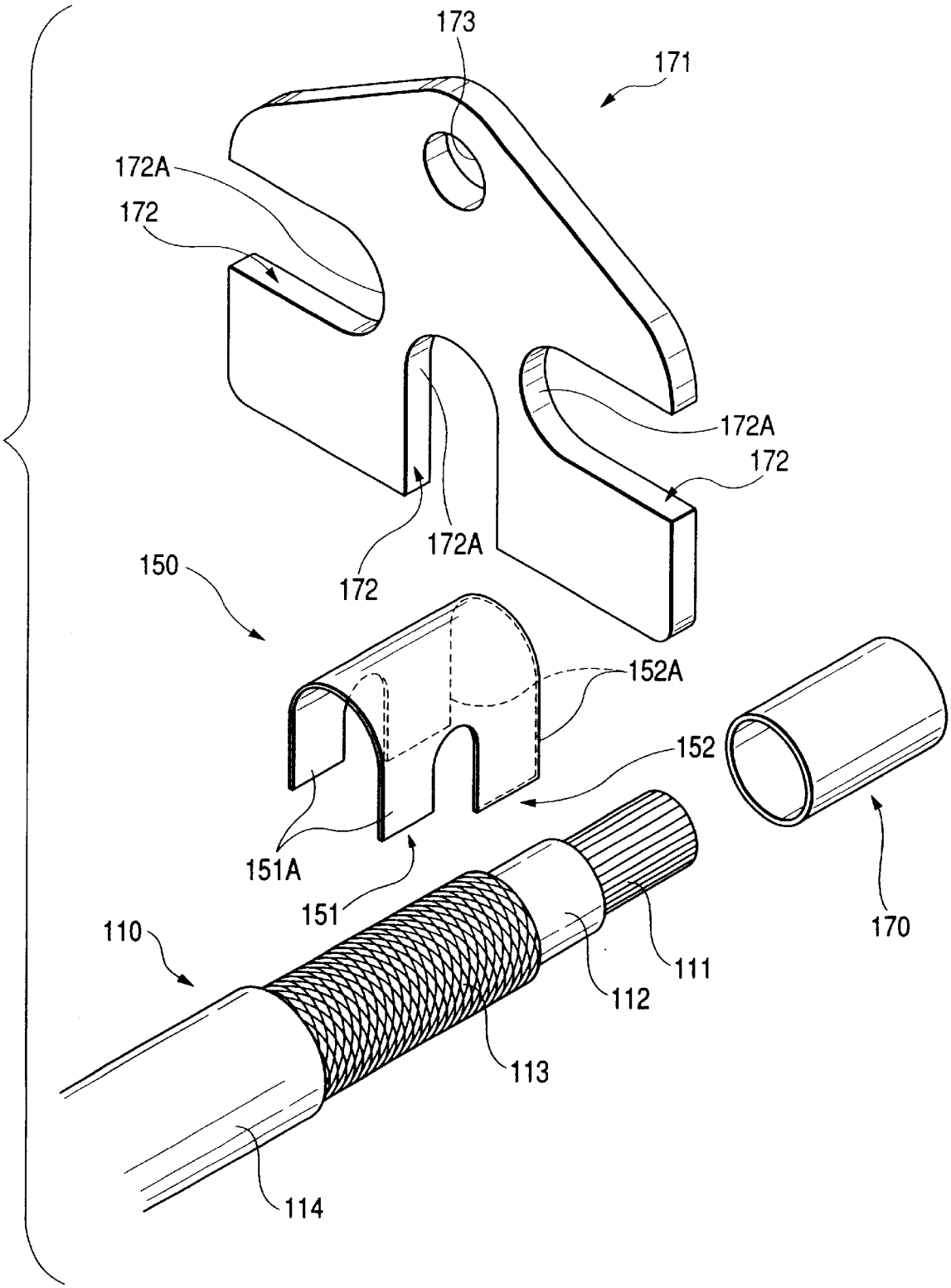
FIG. 16 is an exploded perspective view of a third embodiment.
Figure 17:
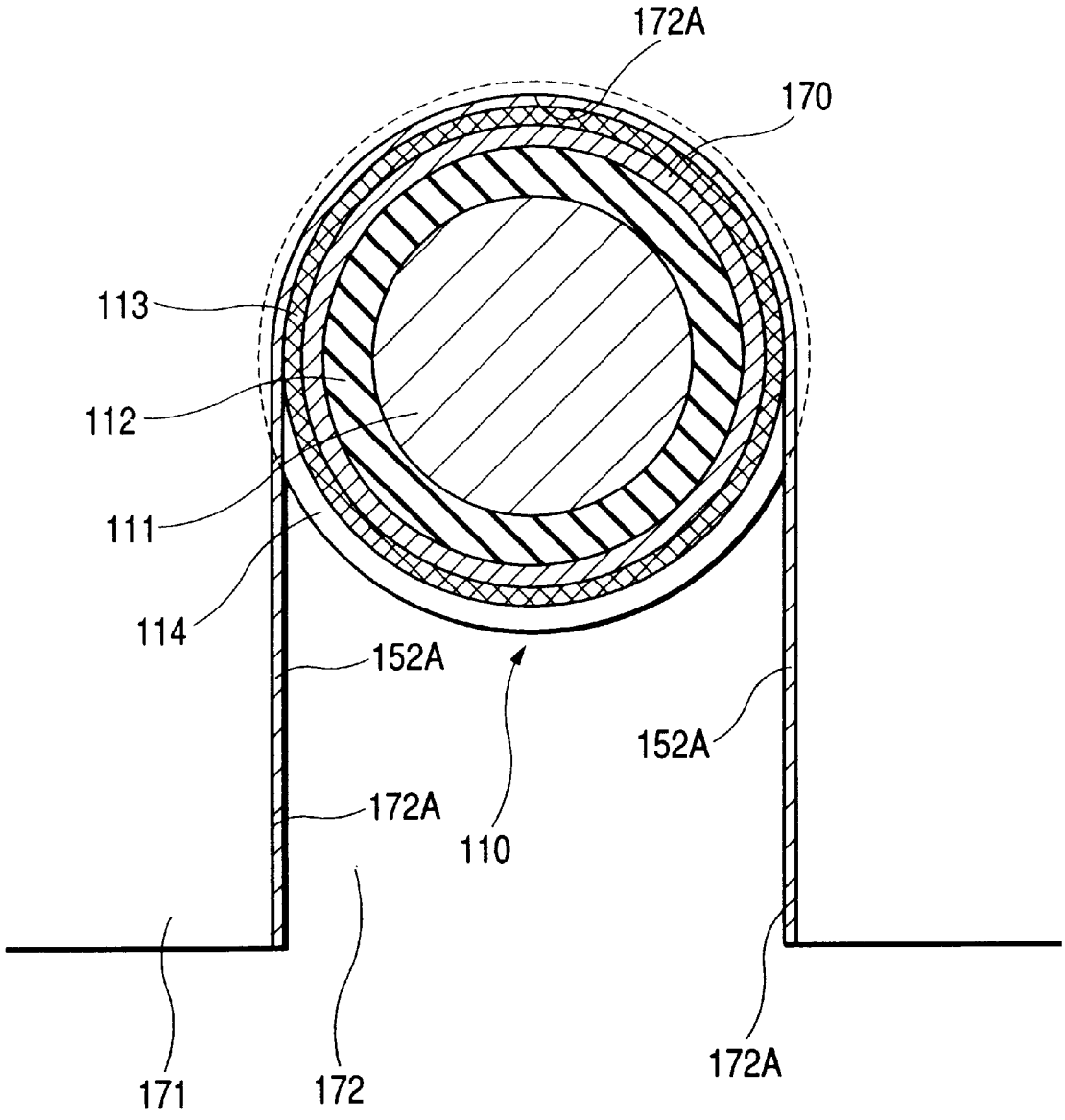
FIG. 17 is a vertical cross-sectional view illustrating a state of connection between the U-shaped slot portion and the shielding layer.

Next, referring to FIGS. 16 and 17, a description will be given of a sixth embodiment of the invention. It should be noted that, in this embodiment, arrangements which are similar to those of the fourth and fifth embodiments will be denoted by the same reference numerals, and a description thereof will be omitted.

In this embodiment, there are provided an electrically conductive flange 171 having three U-shaped slot portions 172 in its side edge portions, the auxiliary barrel 150 of the fifth embodiment, and an inner sleeve 170. It should be noted that, in this embodiment, the use of three shielding wires 110 fitted to the flange 171 is effective for use in a case where a three-phase ac motor is used.

The flange 171 is formed by blanking a metallic plate, and as a whole has a substantially pentagonal shape. A bolt inserting hole 173 is formed at a position close to its upper end, while the U-shaped slot portions 172 are formed in the left-and right-hand sides and the lower side thereof, respectively. Each U-shaped slot portion 172 is open in the outer direction of the flange 171, and a curved surface 172A in its innermost portion has a curvature capable of being brought into close contact with the U-shaped curved portion 152 of the auxiliary barrel 150.

In addition, the inner sleeve 170 is formed of a metallic material into a hollow cylindrical shape, assumes a state of being inserted between the inner insulating layer 112 and the shielding layer 113 of the shielding wire 110, and is crimped by the crimping pieces 151A of the auxiliary barrel 150 from the upper side of the shielding layer 113.

When the shield connector of this embodiment is attached to the shielding wire 110, the inner sleeve 170 is first inserted between the inner insulating layer 112 and the shielding layer 113, and the auxiliary barrel 150 is applied to the shielding layer 113 from a lateral direction to cause the shielding layer 113 to be brought into close contact with the curved portion. The shielding layer 113 is then crimped by the crimping pieces 151A (the similar operation is performed for the two other shielding wires 110 although shown in the drawings).

Next, the U-shaped curved portion 152 of the auxiliary barrel 150 is pressed from its curved side into the U-shaped slot portion 172 formed in the flange 171. Then, the outer surface of the U-shaped curved portion 152 is brought into the substantially entire inner surface of the auxiliary barrel 150. Thus, the flange 122 is conductingly connected to the shielding layer 113 through the auxiliary barrel 150. Thereafter, the shield connector of this embodiment is completed in the same way as in the fourth embodiment. By adopting such an arrangement, it is possible to obtain similar operation and effects similar to those of the above-described fourth embodiment. In addition, in the arrangement provided in this embodiment, since the auxiliary barrel 150 is crimped with the inner sleeve 170 fitted in the shielding layer 113, the arrangement provided is such that the subassembly thus formed is fitted later into the flange 171, so that the assembling efficiency improves.

Figure 18:
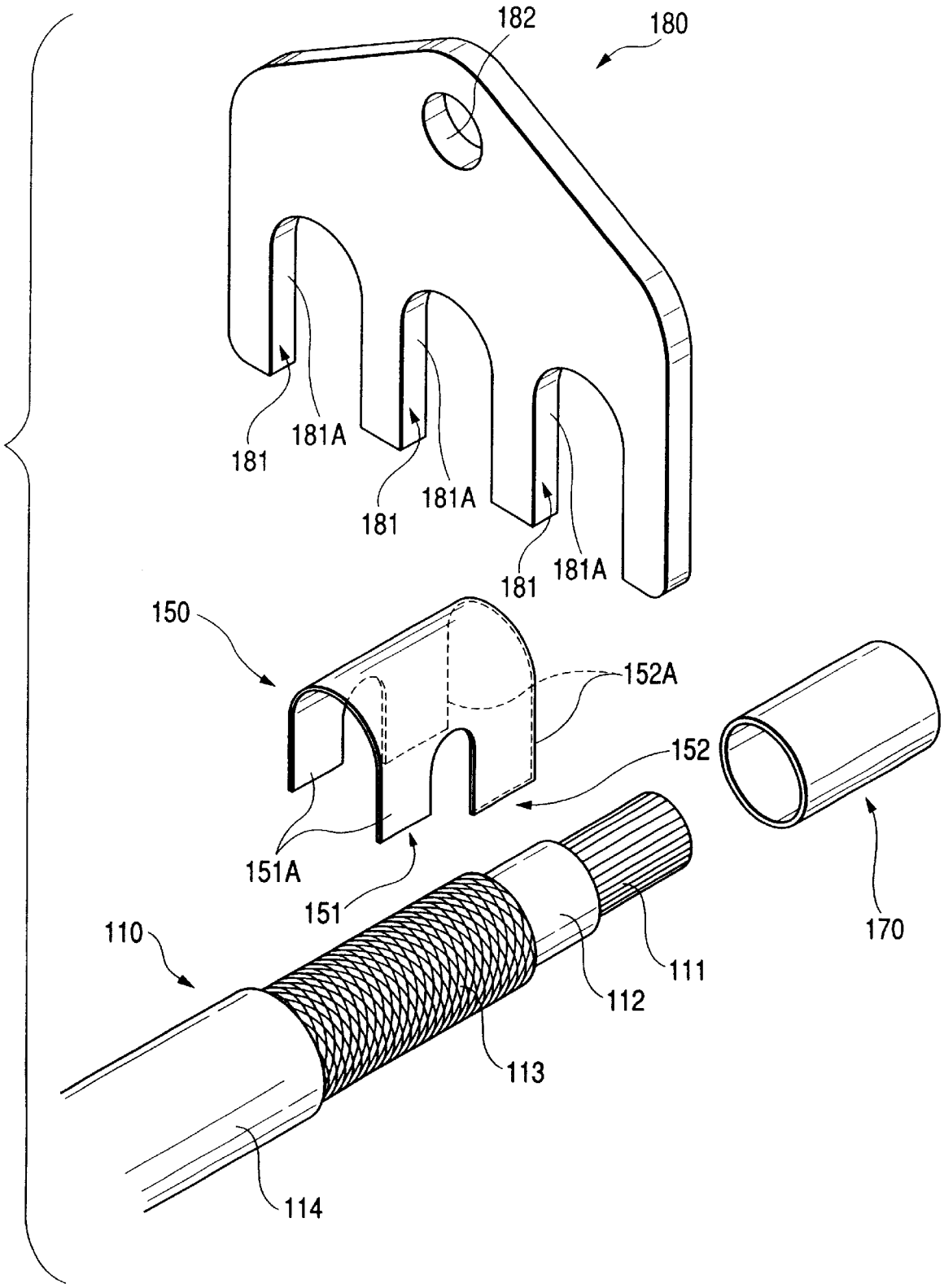
FIG. 18 is an exploded perspective view of a modification of the third embodiment.
Figure 19:
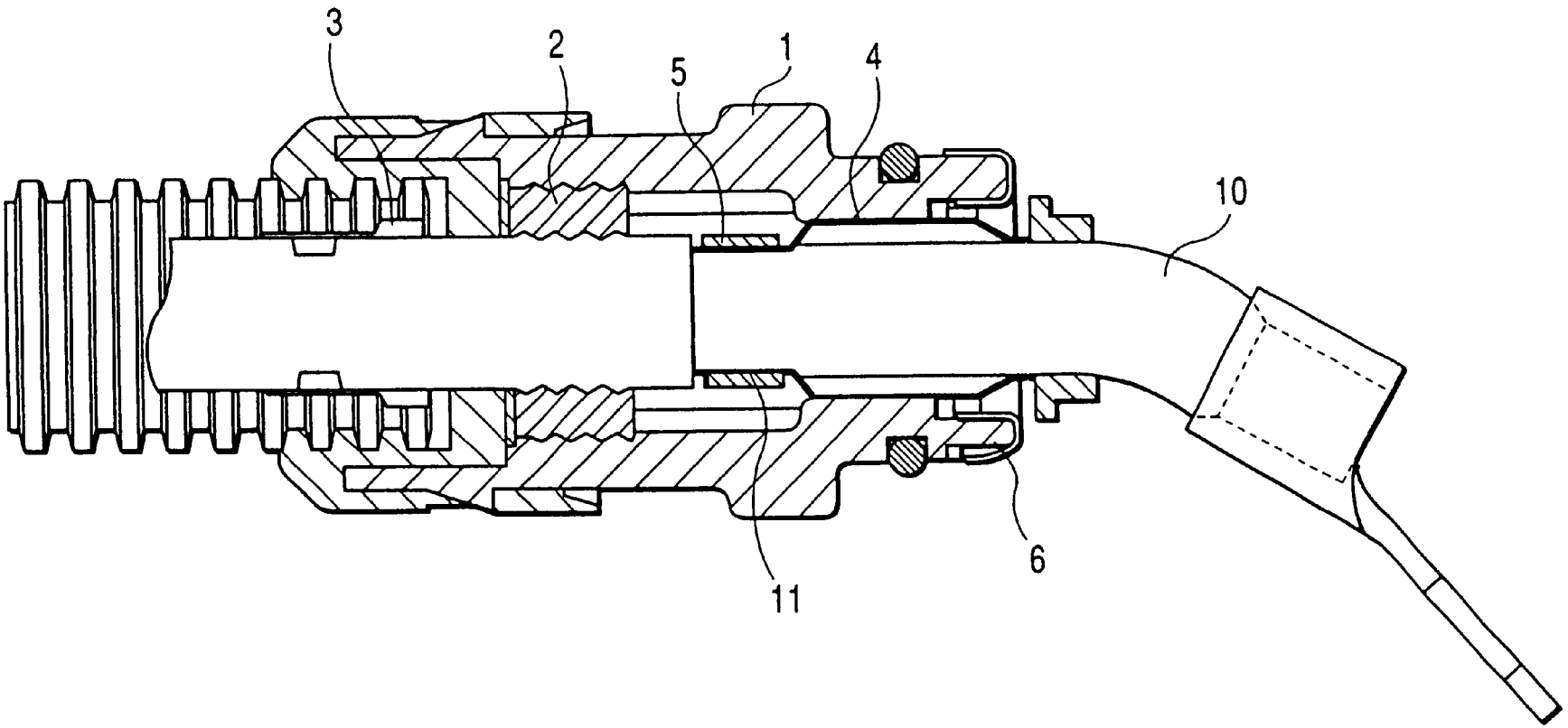
FIG. 19 PRIOR ART
FIG. 19 is a side cross-sectional view of a conventional shield connector.
Figure 20:
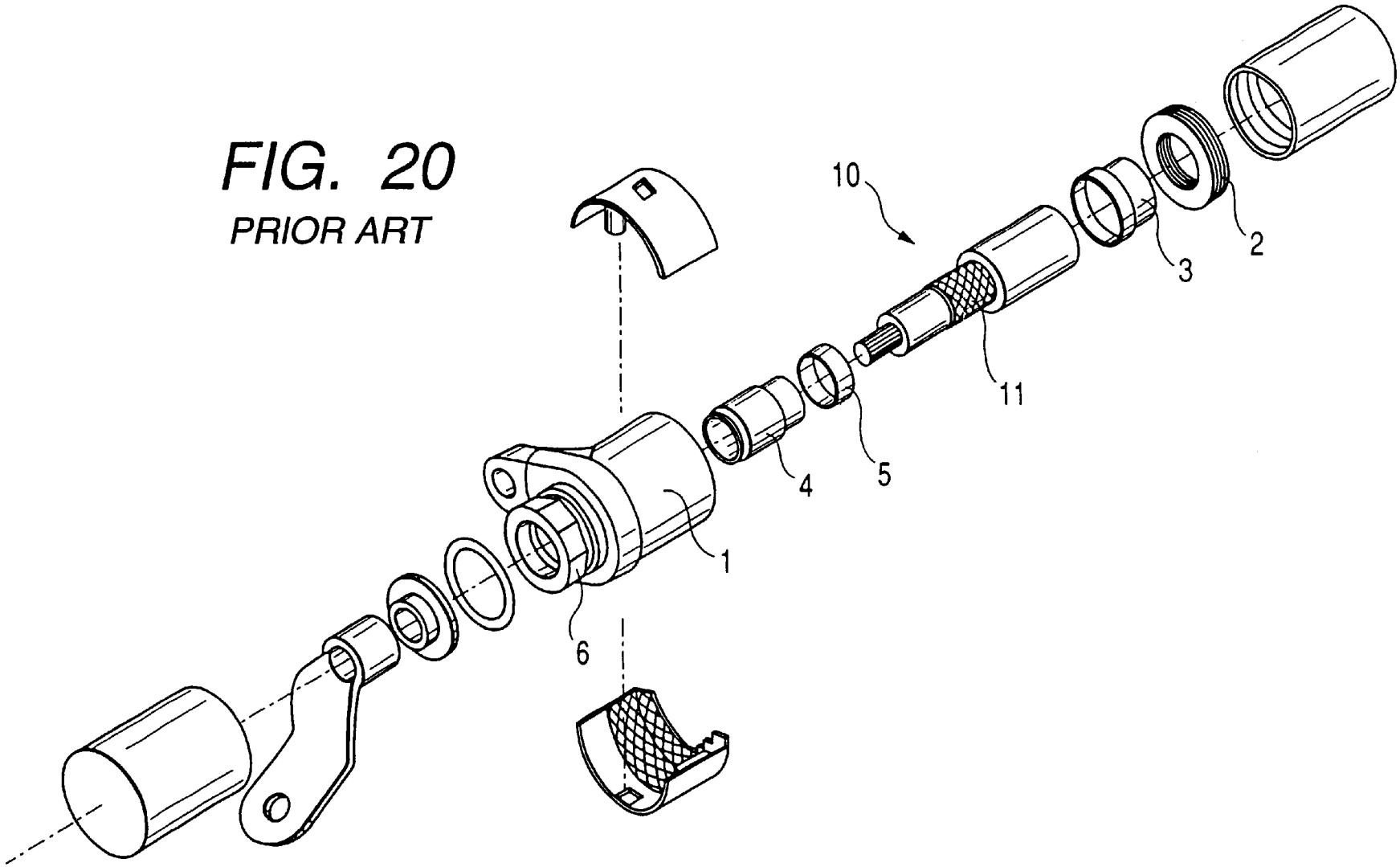
FIG. 20 PRIOR ART
FIG. 20 is an exploded perspective view of the conventional shield connector.

It should be noted that, in this embodiment, the flange in terms of its form may be formed in a transversely wide shape as in the case of a flange 180 in a modification shown in FIG. 18, and may be provided with three U-shaped slot portions 181 in its bottom side. A bolt inserting hole 182 is formed in a central upper end of the flange 180. It should be noted that, in FIG. 18, arrangements similar to those described above are denoted by the same reference numerals, and a description thereof will be omitted.

<Other Embodiments>

The present invention is not limited to the above-described embodiments. For example, embodiments which are described below are also included within the technical scope of the invention, and in addition to the embodiments described below various modifications may be made within the scope which does not depart from the gist.

(1) In the above-described fifth embodiment, an arrangement may be provided such that the sleeve is fitted inside the shielding layer 113, and the auxiliary barrel 150 is crimped on the outer side of the shielding layer 113.

(2) An arrangement may be provided such that, without providing the inner sleeve 127 and the auxiliary barrel 150, the shielding layer 113 is pressed into the U-shaped slot portion 124 formed in the flange 122 from a lateral direction, and is fixed by an electrically conductive adhesive agent, for example.

What is claimed is:

1. A shield connector which covers a shielding layer exposed at a terminal portion of a shielding wire and is fixed to said shielding wire, and which is attached to a mating shielding wall to conductingly connect said shielding layer and said mating shielding wall, said shield connector comprising:

an electrically conductive flange having electrical conductivity and adapted to abut against said mating shielding wall;

an electrically conductive tubular portion provided in a state of being electrically conducting with said electrically conductive flange and fitted to an inner side or an outer side of said exposed shielding layer so as to be conductingly connected to said shielding layer; and a housing fixed to said shielding wire to hold said electrically conductive flange.

2. The shield connector according to claim 1, further comprising:

an auxiliary sleeve fitted to said electrically conductive tubular portion with said shielding layer placed therebetween.

3. The shield connector according to claim 2, wherein said housing is molded by charging a molten resin into a mold for resin molding in a state in which said shielding wire is placed inside said mold.

4. The shield connector according to claim 1, wherein said electrically conductive tubular portion and said shielding layer are fused to each other.

5. The shield connector according to claim 4, wherein said housing is molded by charging a molten resin into a mold for resin molding in a state in which said shielding wire is placed inside said mold.

6. The shield connector according to claim 1, wherein said housing is molded by charging a molten resin into a mold for resin molding in a state in which said shielding wire is placed inside said mold.

7. The shield connector according to claim 6, wherein a resin flowing-in hole for allowing a molten resin to pass therethrough is penetratingly formed in said electrically conductive flange.

8. The shield connector according to claim 6, further comprising:

a waterproofing tubular portion in which a synthetic resin softer than said housing is molded on an outer peripheral surface of said shielding wire prior to molding said housing provided on an inner side of a rear end portion of said housing.

9. The shield connector according to claim 8, wherein a resin flowing-in hole for allowing a molten resin to pass therethrough is penetratingly formed in said electrically conductive flange.

10. A shield connector which covers a shielding layer exposed at a terminal portion of a shielding wire and is fixed to said shielding wire, and which is attached to a mating shielding wall to conductingly connect said shielding layer and said mating shielding wall, said shield connector comprising:

an electrically conductive flange having electrical conductivity and adapted to abut against said mating shielding wall;

a U-shaped slot portion formed in said electrically conductive flange and adapted to accommodate an exposed portion of said shielding layer of said shielding wire and to be conductingly connected to said shielding layer; and a housing molded by disposing said shielding wire together with said electrically conductive flange in a mold for resin molding and by charging a resin into the mold.

11. The shield connector according to claim 10, further comprising:

a waterproof tubular portion in which a synthetic resin softer than said housing is molded on an outer peripheral surface of said shielding wire prior to molding said housing provided on an inner side of a rear end portion of said housing.

12. The shield connector according to claim 10, further comprising:

an inner sleeve fitted on an inner side of said shielding layer and adapted to clamp said shielding layer in cooperation with an inner surface of said U-shaped slot portion.

13. The shield connector according to claim 12, further comprising:

a waterproof tubular portion in which a synthetic resin softer than said housing is molded on an outer peripheral surface of said shielding wire prior to molding said housing provided on an inner side of a rear end portion of said housing.

14. The shield connector according to claim 10, further comprising:

an auxiliary barrel extending along said shielding wire and having at one end thereof a crimping portion for said shielding layer and at another end thereof a U-shaped curved portion for being brought into close contact with an inner surface of said U-shaped slot portion.

15. The shield connector according to claim 14, further comprising:

a waterproof tubular portion in which a synthetic resin softer than said housing is molded on an outer peripheral surface of said shielding wire prior to molding said housing provided on an inner side of a rear end portion of said housing.

* * * * *